US007303846B2

(12) United States Patent
Sakai et al.

(10) Patent No.: US 7,303,846 B2
(45) Date of Patent: Dec. 4, 2007

(54) ELECTROPHOTOGRAPHIC TONER, PROCESS FOR PRODUCING THE SAME, AND PROCESS FOR FORMING IMAGE

(75) Inventors: Sueko Sakai, deceased, late of Kanagawa (JP); by Teruo Sakai, legal representative, Kanagawa (JP); Yuka Ishihara, Kanagawa (JP); Atsuhiko Eguchi, Kanagawa (JP); Masahiro Okita, Kanagawa (JP); Jun Igarashi, Kanagawa (JP); Koichi Sugiyama, Kanagawa (JP); Susumu Yoshino, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 436 days.

(21) Appl. No.: 11/079,193

(22) Filed: Mar. 15, 2005

(65) Prior Publication Data

US 2006/0046173 A1 Mar. 2, 2006

(30) Foreign Application Priority Data

Sep. 2, 2004 (JP) ..... P.2004-255088

(51) Int. Cl.
*G03G 9/00* (2006.01)

(52) U.S. Cl. ..... 430/108.1; 430/108.2; 430/108.23; 430/107.1; 430/137.14

(58) Field of Classification Search ..... 430/108.1, 430/108.2, 108.23, 107.1, 137.14
See application file for complete search history.

(56) References Cited

FOREIGN PATENT DOCUMENTS

| | | |
|---|---|---|
| JP | 49-91231 | 8/1974 |
| JP | A 56-40868 | 4/1981 |
| JP | A 6-118684 | 4/1994 |
| JP | A 6-148928 | 5/1994 |
| JP | A 8-160658 | 6/1996 |
| JP | A 8-234493 | 9/1996 |
| JP | A 8-234494 | 9/1996 |
| JP | A 8-314189 | 11/1996 |
| JP | A 9-80797 | 3/1997 |
| JP | A 9-124960 | 5/1997 |
| JP | A 10-97102 | 4/1998 |
| JP | A 10-123760 | 5/1998 |
| JP | A 10-319623 | 12/1998 |
| JP | A 11-24318 | 1/1999 |
| JP | A 11-84735 | 3/1999 |
| JP | A 11-237765 | 8/1999 |
| JP | A 11-242357 | 9/1999 |
| JP | A 2000-66451 | 3/2000 |
| JP | A 2000-81734 | 3/2000 |
| JP | A 2000-81735 | 3/2000 |
| JP | A 2000-284540 | 10/2000 |
| JP | B2 3141783 | 12/2000 |
| JP | A 2001-109193 | 4/2001 |
| JP | A 2001-109194 | 4/2001 |
| JP | A 2001-109196 | 4/2001 |
| JP | A 2001-290310 | 10/2001 |
| JP | A 2001-312099 | 11/2001 |
| JP | A 2002-91086 | 3/2002 |
| JP | A 2002-182433 | 6/2002 |
| JP | A 2003-140396 | 5/2003 |
| JP | A 2003-149869 | 5/2003 |
| JP | A 2003-156882 | 5/2003 |
| JP | A 2003-195568 | 7/2003 |
| JP | A 2003-202706 | 7/2003 |
| JP | A 2003-207944 | 7/2003 |
| JP | A 2003-207948 | 7/2003 |
| JP | A 2003-280246 | 10/2003 |
| JP | A 2003-280276 | 10/2003 |
| JP | A 2003-280278 | 10/2003 |
| JP | A 2004-61813 | 2/2004 |
| JP | A 2004-61818 | 2/2004 |
| JP | A 2004-77755 | 3/2004 |
| JP | A 2004-77786 | 3/2004 |
| JP | A 2004-85997 | 3/2004 |

*Primary Examiner*—Mark A. Chapman
(74) *Attorney, Agent, or Firm*—Oliff & Berridge, PLC

(57) ABSTRACT

An electrophotographic toner contains at least a binder resin and a colorant, and $\log_{10}\{[Cu]/[C]\}$ satisfies the following equation (1):

$$-5.0 \leqq \log_{10}\{[Cu]/[C]\} \leqq -3.5 \quad (1)$$

in which, [C] represents a carbon content (%) and [Cu] represents a copper content (%), measured with fluorescent X-ray. An electrophotographic developer containing the toner, a method for producing the toner, and a method for forming an image by using the toner are also provided.

19 Claims, No Drawings

ELECTROPHOTOGRAPHIC TONER, PROCESS FOR PRODUCING THE SAME, AND PROCESS FOR FORMING IMAGE

BACKGROUND OF THE INVENTION

1. Field of the Invention

The present invention relates to an electrophotographic toner and an electrophotographic developer capable of being used in an electrophotographic apparatus (image forming apparatus) utilizing an electrophotographic process, such as a duplicator, a printer and a facsimile machine. The invention also relates to an electrophotographic toner, a process for producing the same, and a process for forming an image.

2. Description of the Related Art

A process of visualizing image information through an electrostatic latent image, such as the electrophotographic process, has been widely used in various fields of art. In the electrophotographic process, an electrostatic latent image is formed on a surface of an electrophotographic photoreceptor (an electrostatic latent image carrying member, which is hereinafter sometimes referred simply to as a photoreceptor) through a charging step and an exposing step, and is then developed with a toner for developing an electrostatic latent image (hereinafter, sometimes referred simply to a toner) to form a developed image, which is then subjected to a transferring step and a fixing step to visualize the electrostatic latent image.

As the process for producing a toner, the kneading and pulverizing method and the emulsion polymerization particle aggregating method have been known. A toner obtained by the pulverizing method has a relatively wide particle size distribution and has an irregular shape, and thus the capability thereof is insufficient.

In the emulsion polymerization particle aggregating method, on the other hand, aggregated particles having a particle diameter corresponding to the toner diameter are formed, and then the aggregated particles are fused and integrated by heating to produce the toner. In this method, the structure of the toner can be freely controlled from the inner layer to the surface layer, whereby more precise particle structure control can be realized (as described, for example, in Japanese Patent No. 3,141,783).

In recent years, the image forming process by electrophotography using the toner and developer techniques are being applied to a part of the printing field owing to progress of the digitalization and colorization and conspicuously practiced in the field of graphic arts including on-demand printing. The field of graphic arts referred herein totally means production of creative printed matters with small number of copies, such as those printed by engraving, and mass production of printed matters by replication, duplication and reproduction of original arts, such as calligraphy and painting, and can be defined as a market targeting business fields and sectors relating to production of those printed matters.

However, as compared to the conventional full-fledged printing, the image forming process involves various problems in capability including image quality, such as color reproduction region, resolution and glossiness, texture, uniformity within one image, and maintenance of image quality upon continuous printing for a long period of time, although it can be characterized by on-demand nature as a plate-less printing. Due to the problems, the image forming process is insufficient for applying to the field of graphic arts where market values of productive properties are pursued.

One of the problems relating to stability of images is discoloration or decoloration of a fixed image upon storing for a long period of time. In the field of graphic arts, in particular, the toner density and the color reproduction region are widely distributed on paper, such as maps and photographs, and the tendency of discoloration or decoloration is conspicuous in such a color region that has a low toner density and uses magenta and yellow colors, such as flesh color.

It is considered this is because the colorant molecule absorbs an ultraviolet ray from sunlight or other illuminations to decompose the colorant molecule. A magenta or yellow pigment has absorbance in a short wavelength range and absorbs light having higher energy than a cyan pigment, whereby the bond of the compound constituting the pigment is broken to cause discoloration or decoloration of the pigment. The tendency is conspicuous in such a color region that is of a natural color and has a low toner density, such as flesh color.

Such a method has been proposed that a compound having an ultraviolet ray absorbing capability is contained in a toner along with a pigment to reduce irradiation of the pigment with an ultraviolet ray. In this method, an ultraviolet ray is absorbed, and the light energy thus absorbed is converted to vibration energy within molecules, whereby affection thereof to the other materials in the toner is suppressed. As the material for absorbing an ultraviolet ray, there have been proposed a method of adding a benzophenone compound (as described, for example, in JP-A-06-148928), a method of adding benzophenone and a hindered amine (as described, for example, in JP-A-06-118684), a method of adding a polymer compound having an organic ultraviolet absorbent bonded thereto through covalent bond (as described, for example, in JP-A-09-080797), a method of adding a photochromic material (as described, for example, in JP-A-2004-061813), and a method of adding a thermochromic colorant (as described, for example, in JP-A-2004-061818).

These methods are favorable in ultraviolet ray absorbing capability, but an ultraviolet absorbent represented by benzophenone is generally poor in heat resistance and is liable to be broken due to heat upon kneading and pulverizing and heat upon polymerization in cases of polymerized toners. The molecular skeleton of the ultraviolet absorbent itself is broken upon storing for a long period of time, and the ultraviolet absorbent, which is colorless in the initial stage, is discolored to change the color of the toner. Furthermore, an ultraviolet absorbent not only absorbs an ultraviolet ray and converts the absorbed light energy to vibration energy within molecules, but also often functions as a photosensitizing agent, which transfers the absorbed light energy to other molecules. The tendency of transferring the light energy is conspicuous particularly in the case where the other materials are present in the vicinity of the ultraviolet absorbent as in the toner, and there are some cases where molecules receiving the light energy emit fluorescent light or phosphorescent light. The luminescent amount of fluorescent light or phosphorescent light is generally small, but cannot be ignored in color reproducibility in a natural color region having a low toner density.

Therefore, such toners of yellow color and magenta color are demanded that suffer no discoloration and decoloration due to sunlight or other illuminations, but it is the current situation that the demand cannot be satisfied.

SUMMARY OF THE INVENTION

The present invention has been made in view of the above circumstances and provides such a toner for developing an electrostatic latent image to form a full color image by the electrophotographic process or the electrostatic recording process that is suppressed in discoloration or decoloration of a magenta toner and a yellow toner due to ultraviolet ray irradiation, so as to provide a fixed image capable of being stored for a long period of time even in the case of a natural color image having a low image density, such as flesh color.

According to a first aspect of the invention, an electrophotographic toner includes a binder resin; and a colorant, and $\log_{10}\{[Cu]/[C]\}$ is satisfactory witgh the following equation (1):

$$-5.0 \leqq \log_{10}\{[Cu]/[C]\} \leqq -3.5 \quad (1)$$

wherein [C] represents a carbon content (%) measured with fluorescent X-ray, and [Cu] represents a copper content (%) measured with fluorescent X-ray.

According to a second aspect of the invention, a method for producing for producing an electrophotographic toner includes: aggregating binder resin particles having a particle diameter of 1 μm or less and a colorant to form aggregated particles having a diameter of a toner particle diameter by mixing a binder resin particle dispersion liquid having the binder resin particles dispersed therein and a colorant dispersion liquid having the colorant dispersed therein; and fusing the aggregated particles to form toner particles by heating to a temperature equal to or higher than a glass transition temperature of the binder resin particles, in which a copper compound is made present in at least one of the aggregating and the fusing for controlling a carbon content [C] (%) and a copper content [Cu] (%) measured with fluorescent X-ray to satisfy the following equation (1):

$$-5.0 \leqq \log_{10}\{[Cu]/[C]\} \leqq -3.5 \quad (1)$$

According to a third aspect of the invention, an electrophotographic developer includes: an electrophotographic toner; and a carrier, in which electrophotographic toner includes: a binder resin; and a colorant, and $\log_{10}\{[Cu]/[C]\}$ is satisfactory with the following equation (1):

$$-5.0 \leqq \log_{10}\{[Cu]/[C]\} \leqq -3.5 \quad (1)$$

whrerein [C] represents a carbon content (%) measured with fluorescent X-ray, and [Cu] represents a copper content (%) measured with fluorescent X-ray.

In the invention, a copper compound is contained in the toner particles in an amount in the specific range, whereby a yellow colorant and a magenta colorant can be prevented from being deteriorated, which have been difficult to control discoloration and decoloration thereof due to an ultraviolet ray. Discoloration and decoloration of a color image, particularly a part of flesh color, can be controlled owing to the deterioration preventing capability for yellow and magenta colorants. In the case where an ultraviolet absorbent is contained in the toner particles, discoloration and decoloration of the colorant can be further effectively prevented.

DETAILED DESCRIPTION OF THE PREFFERED EMBODIMENTS

While the invention has been described in detail and with reference to specific embodiments thereof, it will be apparent to one skilled in the art that various changes and modifications can be made without departing from the scope thereof.

This application is based on Japanese patent application No. 2004-255088 filed on Sep. 2, 2004, the entire contents thereof being hereby incorporated by reference.

The invention will be described in detail below.

The inventors have found that discoloration and decoloration of a colorant, in particular deterioration of yellow and magenta colorants due to light, can be prevented by making a copper compound present in a small amount in an electrophotographic toner, and thus the invention has been completed. The inventors have also found that discoloration and decoloration of a colorant can be further effectively prevented by making an ultraviolet absorbent present in the toner containing the copper compound.

A functional group having an unshared electron pair, such as nitrogen and oxygen, exhibits an unstable excited state because of the high energy level of the non-bonding orbital, in which the unshared electron pair is present. In the case where a molecular skeleton has such a structure that another functional group liable to donate an electron through conjugation, such as an aromatic ring, is present in the vicinity of the functional group having an unshared electron pair, the excited state of the functional group having an unshared electron pair becomes further unstable because of the high energy level of the antibonding orbital thus excited.

Accordingly, such a colorant remarkably suffers discoloration or decoloration that has a functional group having an unshared electron pair and has a conjugate part in the vicinity of the functional group.

(Colorant)

In the invention, discoloration and decoloration of a colorant is suppressed by adding a copper compound to the toner. For enjoying the effect of addition of a copper compound, the colorant is preferably an organic colorant having such a molecular skeleton that a functional group having an unshared electron pair and a conjugate part are present in contiguity with each other. Examples of the functional group having an unshared electron pair include functional groups containing nitrogen or oxygen. Examples of the conjugate part include an aromatic ring, a heterocyclic ring, an alkene and an alkyne. The organic colorant preferably has the following functional groups.

Preferred examples of the functional group contained in the organic colorant include an anisidino group, an anisoyl group, an anilino group, an isoquinolyl group, an isonicotinoyl group, an isophthaloyl group, an indolyl group, a quinolidino group, a xanthenyl group, a xylyl group, a quinolyl group, a salicylidene group, a salicyl group, a salicyloyl group, a diphenylamino group, a diphenylmethylene group, a cinnamyl group, a cinnamoyl group, a styryl group, a sulfanylyl group, a sulfanylamide group, a toluidino group, a toluoyl group, a naphthylazo group, a naphthyloxy group, a naphthoyl group, a naphthoyloxy group, a nicotinoyl group, a piperidino group, a piperidyl group, a piperonyl group, a pimeloyl group, a pyrazinyl group, a pyrazonyl group, a pyrazolyl group, a pyranyl group, a pyridinio group, a pyridyl group, a pyridyloxy group, a 2-pyridinecarbonyl group, a pyrimidinyl group, a pyrrolidinyl group, a pyrrolinyl group, a pyrrolyl group, a phenylazo group, a phenylimino group, a phenylcarbamoyl group, a phenylsulfamoyl group, a phenylsulfinyl group, a phenylsulfonylamino group, a phenylthio group, a phenylacetyl group, a phenacylidene group, a phenacyl group, a phthalidylidene group, a phthalidyl group, a phthalimide group, a phthaloyl group, a furyl group, a fluorenyl group, a fluorenylidene group, a benzilidene group, a benzyloxy group, a benzyloxycarbonyl group, a benzylthio group, a benzamide group, a benzimidoyl group, a benzhydrilidene group, a benzoylimino group, a benzoyloxy group, a benzoquinonyl group and a benzofuranyl group.

Examples of the colorant, for which the copper compound used in the invention is effective, are shown below.

Specific examples of the yellow colorant include a monoazo pigment, such as C.I. Pigment Yellow 74 represented by the following formula (3), and C.I. Pigment Yellow 1, 2, 3, 5, 6, 49, 65, 73, 75, 97, 98, 111, 116 and 130; a benzimidazolone pigment, such as C.I. Pigment Yellow 154 represented by the following formula (4), and C.I. Pigment Yellow 120, 151, 175, 180, 181 and 194; a disazo condensation pigment, such as C.I. Pigment Yellow 93 represented by the following formula (5), and C.I. Pigment Yellow 94, 95, 128 and 166; an isoindolinone pigment, such as C.I. Pigment Yellow 110 represented by the following formula (6), and C.I. Pigment yellow 109; an anthraquinone pigment, such as C.I. Pigment Yellow 147 represented by the following formula (7), and C.I. Pigment Yellow 24, 108, 193 and 199; a disazo pigment, such as C.I. Pigment Yellow 12, 13, 14, 17, 55, 63, 81, 83, 87, 90, 106, 113, 114, 121, 126, 127, 136, 152, 170, 171, 172, 174, 176 and 188; an azolake pigment, such as C.I. Pigment Yellow 61, 62, 133, 168 and 169; an isoindolinone pigment, such as C.I. Pigment Yellow 139; and a quinophthalone pigment, such as C.I. Pigment Yellow 138.

(3)

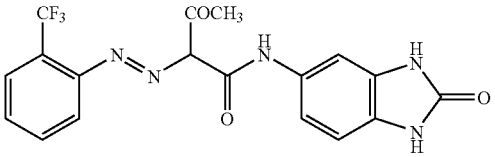

(4)

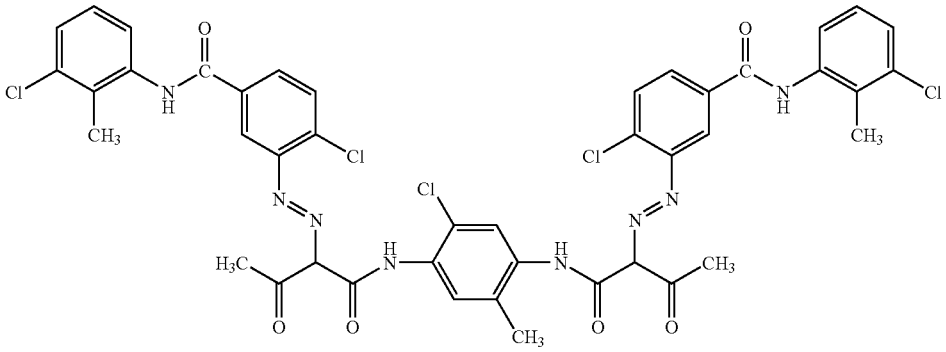

(5)

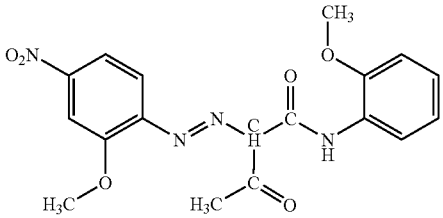

(6)

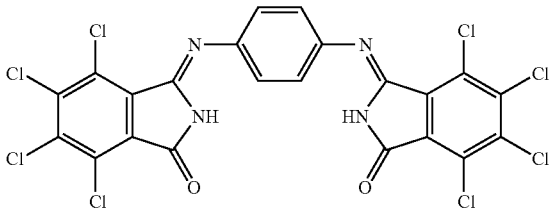

(7)

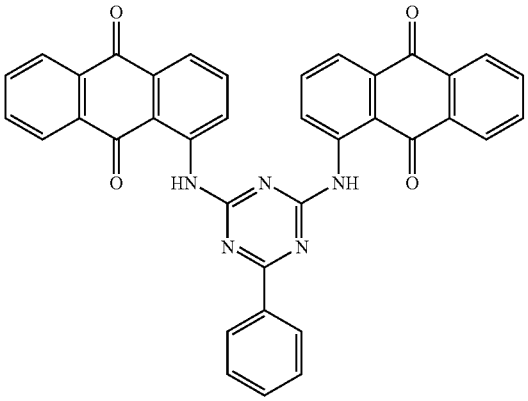

Specific examples of the magenta colorant include a β-naphthol pigment, such as C.I. Pigment Red 146 represented by the following formula (8), and C.I. Pigment Red 2, 5, 7, 8, 9, 10, 11, 12, 13, 14, 15, 16, 17, 18, 21, 22, 23, 31, 32, 95, 112, 114, 119, 136, 147, 148, 150, 164, 170, 184, 187, 188, 210, 212, 213, 222, 223, 238, 245, 253, 256, 258, 261, 266, 267, 268 and 269; an azolake pigment, such as C.I. Pigment Red 57:1 represented by the following formula (9), and C.I. Pigment Red 18:1, 48:2, 48:3, 48:4, 48:5, 50:1, 51, 52:1, 52:2, 53:1, 53:2, 53:3, 58:2, 58:4, 64:1, 68 and 200; a quinacridone pigment, such as C.I. Pigment Red 209 represented by the following formula (10), C.I. Pigment Red 122, 192, 202 and 207, and C.I. Pigment Violet 19; a disazo pigment, such as C.I. Pigment Red 37, 38, 41 and 111, and C.I. Pigment Orange 13, 15, 16, 34 and 44; a benzimidazolone pigment, such as C.I. Pigment Red 171, 175, 176, 185 and 208, C.I. Pigment Violet 32, and C.I. Pigment Orange 36, 60, 62 and 72; a disazo condensation pigment, such as C.I. Pigment Red 144, 166, 214, 220, 221, 242, 248 and 262, and C.I. Pigment Orange 31; a dioxadine pigment, such as C.I. Pigment Violet 23 and 37; and a diketo pyrrolopyrrole pigment, such as C.I. Pigment Red 254, 255, 264 and 272, and C.I. Pigment Orange 71 and 73.

(8)

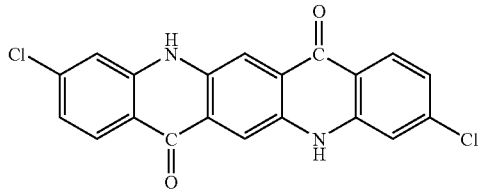

(9)

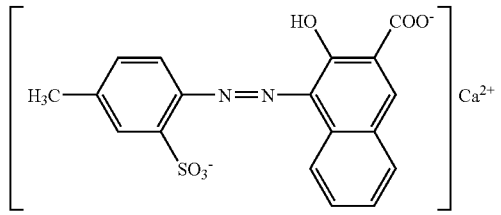

(10)

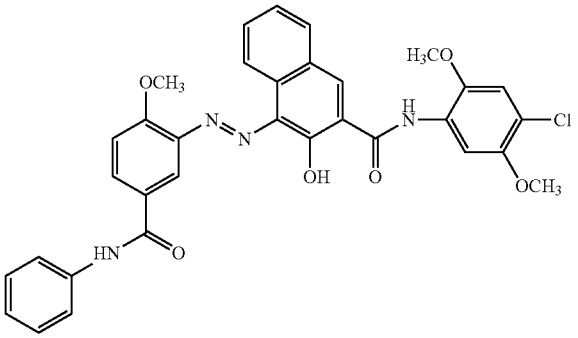

Various colorants have been proposed for yellow and magenta colorants that are liable to suffer discoloration or decoloration with light including an ultraviolet ray. The copper compound used in the invention is also effective for prevention of light discoloration and decoloration of the yellow colorants and the magenta colorants shown below.

For the yellow colorant, the methods using the yellow pigments and dyes disclosed in JP-A-08-234493, JP-A-08-234494, JP-A-11-237765, JP-A-11-242357, JP-A-2000-066451, JP-A-2000-081735, JP-A-2000-284540, JP-A-2001-109193, JP-A-2001-109194, JP-A-2001-312099, JP-A-2003-156882, JP-A-2003-195568, JP-A-2003-280276, JP-A-2003-280278, JP-A-2004-077755, JP-A-2004-077786 and JP-A-2004-085997 are proposed, and the method using the diketo pyrrolopyrrole pigment disclosed in JP-A-08-160658 is also proposed.

For the magenta colorant, the methods using the magenta pigments and dyes (such as an anthraquinone series, a quinacridone series, a monoazo series and a condensation azo series) disclosed in JP-A-08-314189, JP-A-09-124960, JP-A-10-097102, JP-A-10-319623, JP-A-11-024318, JP-A-11-084735, JP-A-2000-081734, JP-A-2002-091086, JP-A-2002-182433, JP-A-2003-202706, JP-A-2003-207944, JP-A-2003-207948 and JP-A-2003-280246, the methods using plural kinds of pigments and dyes disclosed in JP-A-10-123760, JP-A-2003-140396 and JP-A-2003-149869 are proposed.

(Copper Compound)

The toner of the invention contains a small amount of a copper compound to suppress the colorant from suffering discoloration or decoloration.

The preferred addition amount of the copper compound is determined by the copper content [Cu] (%) with respect to the carbon content [C] (%) in the toner and is $-5.0 \leqq \log_{10}\{[Cu]/[C]\} \leqq -3.5$. The carbon content [C] (%) and the copper content [Cu] (%) in the toner are measured with fluorescent X-ray.

The measurement method of the carbon content [C] (%) and the copper content [Cu] (%) with fluorescent X-ray will be described. As a pre-treatment, 6 g of the toner to be measured is molded under pressure at 10 t for 1 minute in a pressure molding machine, and the molded toner is measured by using a fluorescent X-ray apparatus XRF-1500, produced by Shimadzu Corp., under measuring conditions of an X-ray tube voltage of 40 kV, an X-ray tube current of 90 mA and a measuring time of 30 minutes.

A large proportion of the toner is occupied by the binder resin, and the binder resin mainly formed of carbon and hydrogen. Therefore, it can be considered that the amount of carbon atoms and the weight of the toner are proportional to each other.

The content of the copper compound is expressed as a ratio with respect to the carbon content. In the case where the ratio satisfies the relationship shown by the following equation (1), an image formed of the toner can be controlled in discoloration and decoloration, and simultaneously the change of the color tone of the toner due to the copper compound can be suppressed.

$$-5.0 \leqq \log_{10}\{[Cu]/[C]\} \leqq -3.5 \quad (1)$$

The colorant is dispersed in a size of from several nanometer to several tens nanometer in the toner, and the size is considerably large in comparison to the molecules of the colorant. Therefore, only a small part of the colorant absorbs an ultraviolet ray. Furthermore, only apart of the small part of the colorant suffers ionization to cause discoloration or decoloration, and thus the amount of the copper compound necessary for preventing the discoloration or decoloration is only a considerably small amount. This is because the dispersed diameter of the copper compound in the toner is sufficiently small in comparison to the dispersion diameter of the colorant, and thus only a small amount of the copper compound exerts the intended effects.

The copper compound that can be used in the invention is a copper compound containing a monovalent copper cation Cu(I) or a divalent copper cation Cu(II). An anion constituting the copper compound is (1/n) of inorganic or organic n-valent anions, wherein n represents a natural number, and preferably 1 or 2. Preferred examples of the anion include an inorganic anion, such as a halogenide ion, a halogen acid ion, a perhalogen acid ion, a hydroxide ion, a carbonate ion, a nitrate ion, a sulfate ion, a selenate ion, a formate ion, an acetate ion, an oxalate ion, a thiocyanate ion, a hexafluorosilicate ion and a tetrafluoroborate ion, and an organic anion, such as a monovalent anion of 2,4-pentanedione and a monovalent anion of glycine.

The copper compound includes copper oxide, copper sulfide and copper selenate. A mixed oxide containing copper oxide and an oxide of another metal may be used.

Examples of the copper compound also include a copper complex with an organic ligand, and examples of the organic ligand include unidentate and multidentate ligands, such as amine, phosphine, nitrile, isonitrile, carbonyl, alkene, alkyne and diene.

Specific examples of the copper compound include copper(II) fluoride, copper(I) chloride, copper(II) chloride, copper(II) chlorate, copper(II) perchlorate, copper(I) bromide, copper(II) bromide, copper(I) iodide, copper(I) oxide, copper(II) oxide, copper(II) hydroxide, copper(II) sulfide, copper(II) sulfate, copper(I) selenide, copper(II) selenide, copper(II) selenate, copper(I) nitrate, copper(II) nitrate, copper (II) phosphate, copper(I) carbonate, dicopper(II) carbonate dihydroxide, copper (I) thiocyanate, diiron(III) copper (II) oxide, copper(II) hexafluorosilicate, copper(II) tetrafluoroborate, copper(II) acetate, copper(II) oxalate, bis (2,4-pentanedionato) copper(II), bis(glycinato)copper(II), tetraammine copper(II) sulfate and bis(ethylenediamine) copper(II).

Among these, a copper halogenide, such as copper(II) fluoride, copper(I) chloride, copper(II) chloride, copper(I) bromide and copper(II) bromide, copper(I) carbonate and copper(II) nitrate are preferred since these compounds are relatively resistant to heat, and copper(I) chloride, copper(I) bromide and copper(I) carbonate are particularly preferred. These compounds are also preferred since they are water soluble and can be easily mixed in the toner particles.

The water solubility of the copper compounds is determined by the mass (g) of the copper compound contained in 100 g of a 1N nitric acid aqueous solution at 20° C., and a compound exhibiting a solubility of 0.01% or more is determined as being water soluble.

The aforementioned copper compounds are of hypochromic colors, and the color tone of the yellow or magenta colorant used in the invention is not changed upon adding the copper compounds thereto to prevent reproducibility of flesh color from being deteriorated.

(Electrophotographic Toner)

The electrophotographic toner of the invention contains a binder resin, a colorant and a copper compound, and also contains, depending on necessity, other components, such as a releasing agent. The electrophotographic toner of the invention can prevent discoloration or decoloration and can provide a fixed image excellent in light resistance.

(Production Process of Toner)

The production process of the electrophotographic toner of the invention is not particularly limited and may be the kneading and pulverizing method, the emulsion polymerization aggregation method or the suspension polymerization method, and the emulsion polymerization aggregation method is particularly preferably used. It is preferred in the toner of the invention that the copper compound is dispersed in the vicinity of the colorant dispersed in the toner, and in the kneading and pulverizing method, there are some cases where the copper compound cannot be sufficiently dispersed upon kneading. In the suspension polymerization method, the copper compound is necessarily dispersed or dissolved in a polymerizable monomer, but since the polymerizable monomer is generally an organic compound, there are some cases where the copper compound can not be dispersed therein or is difficult to be dissolved therein.

In the emulsion polymerization aggregation method, on the other hand, a resin particle dispersion liquid having resin particles having a particle diameter of 1 μm or less dispersed therein is mixed with a colorant dispersion liquid having the colorant dispersed therein, so as to aggregate the resin particles and the colorant to the toner diameter (hereinafter, this step is sometimes referred to as a aggregating step), and the copper compound can be simultaneously present in the aggregating step, whereby the problems associated with the other methods can be avoided. It is more preferred that the copper compound is water soluble, since the water soluble copper compound can be added to the interior of the toner particles in the molecular level. It is further preferred that a carboxyl group-containing monomer is added to the components of the polymerizable monomers constituting the resin particles, since the carboxyl group and copper can form a salt structure in the polymer thus formed. The aggregated particles formed through the aggregating step are fused by heating to a temperature equal to or higher than the glass transition temperature of the binder resin particles to form toner particles (hereinafter, this step is sometimes referred to as a fusing step).

In the aggregating step, the particles contained in the resin particle dispersion liquid, the colorant dispersion liquid and, depending on necessity, the releasing agent dispersion liquid, which have been mixed with each other, are aggregated to form aggregated particles having the toner diameter. The aggregated particles are formed through hetero aggregation, to which an ionic surfactant having a polarity opposite to the aggregated particles or a monovalent or larger valent compound, such as a metallic salt, is added for stabilizing the aggregated particles and for controlling the particle diameter and/or the particle diameter distribution of the aggregated particles.

The toner diameter referred herein means the volume average particle diameter of the toner mentioned below.

In the fusing step, the resin particles contained in the aggregated particles are fused under the temperature condition that is equal to or higher than the glass transition temperature thereof, whereby the aggregated particles are transformed from an irregular shape to a spherical shape. The copper compound contained in the aggregated particles can be controlled since it remains in the particles irrespective to the progress of the fusing operation. Such a copper compound can be further easily controlled that forms a salt structure with a carboxyl group contained in the aggregated particles. Thereafter, the aggregated particles are separated from the aqueous medium and, depending on necessity, subjected to washing and drying, to obtain toner particles.

The volume average particle diameter of the toner is preferably about from 2 to 10 μm, more preferably from 3 to 8 μm, and further preferably from 5 to 7 μm. The particle diameter distribution of the toner is preferably as narrow as possible, and more specifically, the value GSDp represented by the following equation, which is a square root of a ratio of an accumulated number of particles from the smaller particle diameter to the 16% diameter (abbreviated as D16p) and an accumulated number of particles to the 84% diameter (abbreviated as D84p), is preferably 1.40 or less, more preferably 1.31 or less, and particularly preferably from 1.20 to 1.27.

$$GSDp=\{(D84p)/(D16p)\}^{0.5}$$

In the case where the volume average particle diameter and GSDp are in the aforementioned ranges, flesh color as natural color can be favorably reproduced, and a toner in the layer farthest from a transfer material can be favorably transferred in the transferring step of the electrophotographic process.

The shape factor SF1 of the toner is preferably in a range of from 110 to 140, and more preferably from 120 to 140. It has been known that a spherical toner can be easily transferred in the transferring step of the electrophotographic process, and a toner having an irregular shape can be easily cleaned in the cleaning step. Under consideration of color reproduction of the area of natural color, such as flesh color, having a small amount of toner coverage per unit area, the aforementioned range of SF1 is preferred in the invention.

(Estimated Function of Copper Compound)

Although the mechanism of prevention of light degradation of the colorant obtained by adding the copper compound has not yet been completely clear, the following possibilities can be estimated. It is noted that the reliability of the mechanism described herein has no influence on the effectiveness of the invention.

There is such a possibility that the copper compound functions as a quenching agent to the excited colorant molecule, so as to prevent discoloration or decoloration of the colorant.

Light absorbed by the colorant excites an electron, and thus the molecule turns into an electronically excited state. The molecule in an electronically excited state returns to the ground state through one or more processes of (a) reaction, (b) deactivation (radiation or non-radiation process) and (c) energy transfer, as the photochemical primary process.

In the case where the colorant is an organic pigment or an organic dye having a large molecule size, conversion of the electron excitation energy to the vibration energy of the process (b) is hindered because steric hindrance is liable to occur with the binder resin or the like present adjacent to the molecule in the toner, whereby the electron excitation state becomes unstable. As a result, ionization of the colorant molecule is liable to occur, whereby discoloration or decoloration of the colorant becomes remarkable through the chemical reaction of the process (a).

It is considered that the copper compound used in the invention receives the excitation energy from the excited colorant molecule to excite the outermost electron of the copper atom (i.e., the process (c)), whereby discoloration or decoloration of the colorant is prevented. It is considered that the copper compound is less influenced by the steric hindrance owing to the smaller molecule size than the colorant, and thus the electron excitation energy can be effectively converted to the vibration energy.

Such a possibility is also considered that the copper compound functions as a scavenger of an excited oxygen molecule.

It is considered that a singlet oxygen molecule excited with light on the toner surface has high reactivity and oxidizes the colorant present in the vicinity thereof to cause discoloration or decoloration. In the case where the copper compound capable of effectively quenching the excited oxygen molecule is added, it is considered that the excited oxygen atom can be deactivated to prevent the colorant from being deteriorated.

(Ultraviolet Absorbent)

The toner of the invention preferably contains an ultraviolet absorbent. The ultraviolet absorbent used in the invention may be those having been known in the art.

Representative examples of the ultraviolet absorbent include a benzophenone compound, a benzotriazole compound, a salicylic acid compound, a p-aminobenzoic acid compound, an anilide compound, a triazine compound and a benzoate compound, and mixtures of these compounds may be used.

Specific examples thereof include 2,4-dihydroxybenzophenone,
2-hydroxy-4-n-octyloxybenzophenone,
2-hydroxy-4-methoxybenzophenone,
2-hydroxy-4-methoxybenzophenone-5-sulfonic acid, sodium
2-hydroxy-4-methoxybenzophenone-5-sulfonate,
2-hydroxy-4-methoxy-2'-carboxybenzophenone,
4-benzyloxy-2-hydroxybenzophenone,
2,2'-dihydroxy-4,4'-dimethoxybenzophenone,
2,4-dihydroxybenzophenone, phenyl salicylate, 2-ethylhexyl
salicylate, p-octylphenyl salicylate, p-tert-butylphenyl salicylate, p-aminobenzoic acid, glyceryl p-aminobenzoate,
ethyl 2-cyano-3,3'-diphenylacrylate,
2-(2-hydroxy-5-methylphenyl)-2H-benzotriazole,
2-(3-tert-butyl-2-hydroxy-5-methylphenyl)-5-chloro-2H-benzot riazole, 1,6-bis(4-benzoyl-3-hydroxyphenoxy) hexane,
2-(5-methyl-2-hydroxyphenyl)benzotriazole,
2-[2-hydroxy-3,5-bis(α,α-dimethylbenzyl)phenyl]-2H-benzotria zole,
2-(3-tert-butyl-5-methyl-2-hydroxyphenyl)-5-chlorobenzotriaz ole, 2-(2'-hydroxy-5'-t-octylphenyl)benzotriazole,
2-ethoxy-2'-ethyloxalic acid bisanilide,
2-(4',6-diphenyl-1,3,5-triazin-2-yl)-5-[(hexyl)oxy]phenol
and 2-(3,5-di-tert-butyl-4-hydroxybenzyl)-2-n-butylmalonic acid bis (1,2,2,6,6-pentamethyl-4-piperidyl) The invention is not limited to these compounds, and any kind of ultraviolet absorbent can be used.

The ultraviolet absorbent may be used solely or used in combination of two or more thereof. The kinds and the amounts of the ultraviolet absorbent may be adjusted under consideration of the characteristics of the toner. For example, it is necessary that no problem occurs in powder flowability, blocking upon storing, charging property and fixing property upon using. In the case where the ultraviolet absorbent is externally added to the toner mother particles, the amount thereof is preferably from 0.1 to 3.0% by weight based on the toner composition, and in the case where the ultraviolet absorbent is internally added to the toner mother particles, the amount thereof is preferably from 0.3 to 7.0% by weight based on the toner composition. In the case where the addition amount of the ultraviolet absorbent is in the aforementioned range, the charging property and the powder flowability of the toner are not deteriorated. The ultraviolet absorbent preferably has high affinity to the binder resin since the ultraviolet absorbent can be uniformly dispersed in the fixed image, and exhibits no adverse affect on the coloring property. The ultraviolet absorbent having high affinity to the binder resin does not form crystals in the fixed image to provide good light permeability.

Examples of the method of adding the ultraviolet absorbent to the toner include a method of mixing the ultraviolet absorbent in a powder form with the toner particles, a method of adding the ultraviolet absorbent upon melting and kneading the binder resin or the colorant, and a method of internally adding the ultraviolet absorbent to the particles by mixing or chemically bonding upon emulsifying or granulating through aggregation in an aqueous medium.

(Binder Resin)

Examples of the binder resin that can be used in the electrophotographic toner of the invention include an ethylenic resin, such as polyethylene and polypropylene, a styrene resin mainly containing polystyrene or poly(α-methylstyrene), a (meth) acrylate resin mainly containing polymethyl methacrylate or polyacrylonitrile, a polyamide resin, a polycarbonate resin, a polyether resin, a polyester resin and a copolymer resin thereof, and a styrene resin, a (meth) acrylate resin, a styrene-(meth) acrylate copolymer resin and a polyester resin are preferred from the standpoint of charging stability and development durability upon using in the electrophotographic toner.

Examples of a condensation monomer used in the polyester resin include condensation monomer components disclosed in Kobunshi Data Handbook, Kiso-hen (Polymer Data Handbook, Fundamental Edition), edited by The Society of Polymer Science, Japan, published by Baifukan Co., Ltd., such as divalent or trivalent or higher valent carboxylic acids and divalent or trivalent or higher valent alcohols. Specific examples of the divalent carboxylic acid include a dihydric acid, such as succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexanedicarboxylic acid, malonic acid and mesaconic acid, anhydrides of these dihydric acids, lower alkyl esters of these dihydric acid, and an aliphatic unsaturated dicarboxylic acid, such as maleic acid, fumaric acid, itaconic acid and citraconic acid. Examples of the trivalent or higher valnet carboxylic acid include 1,2,4-benzenetricarboxylic acid, 1,2,5-benzenetricarboxylic acid, 1,2,4-naphthalenetricarboxylic acid, anhydrides thereof, and lower alkyl esters thereof. These acids may be used solely or used in combination of two or more kinds thereof.

Examples of the divalent alcohol include bisphenol A, hydrogenated bisphenol A, an ethylene oxide and/or propylene oxide adduct of bisphenol A, 1,4-cyclohexanediol, 1,4-cyclohexanedimethanol, ethylene glycol, diethylene glycol, propylene glycol, dipropylene glycol, 1,3-butanediol, 1,4-butanediol, 1,5-pentanediol, 1,6-hexanediol, 1,9-nonanediol and neopentyl alcohol. Examples of trivalent or higher valent alcohol include glycerin, trimethylolethane, trimethylolpropane and pentaerythritol. These alcohols may be used solely or used in combination of two or more kinds thereof. In order to adjust the acid value or the hydroxyl group value, a monovalent acid, such as acetic acid and benzoic acid, or a monovalent alcohol, such as cyclohexanol and benzyl alcohol, may be used depending on necessity.

The polyester resin can be produced by using an arbitrary combination selected from the aforementioned condensation monomer components by the process having been known in the art described, for example, in *Jushukugo* (Polycondensation), published by Kagaku-Dojin Publishing Company, Inc. (1971), *Kobunshi Jikken Kagaku* (*Jushukugo to Jufuka*) (Polymer Experimental Chemistry (Polycondensation and Polyaddition)), published by Kyoritsu Shuppan Co., Ltd. (1958) and *Polyester Jushi Handbook* (Polyester Resin Handbook), published by Nikkan Kogyo Shimbun, Ltd. (1988), and the ester exchange method, the direct polycondensation method and the like may be used solely or in combination of plural methods.

As having been described, a carboxyl group preferably remains in the molecule skeleton of the resin. Because it is difficult to introduce a carboxyl group to the side molecular chain of the polyester resin from the standpoint of production process, carboxyl groups are introduced to the both ends of the resin molecule to obtain a certain effect in controlling the content of the copper compound. Therefore, the acid value of the resin is preferably as high as possible, and specifically the acid value is preferably from 5 to 50 mgKOH/g, and more preferably from 10 to 40 mgKOH/g.

A styrene resin and a (meth) acrylate resin, particularly, a styrene-(meth)acrylate copolymer resin, are useful as the binder resin in the invention.

For example, a monomer mixture containing from 60 to 90 parts by weight of vinyl aromatic monomer (i.e., a styrene monomer), from 10 to 40 parts by weight of an ethylenic unsaturated carboxylate monomer (i.e., a (meth) acrylate monomer) and from 1 to 3 parts by weight of an ethylenic unsaturated acid monomer is polymerized to form a copolymer, and the copolymer is dispersed and stabilized to form latex, which can be preferably used as the binder resin component in the invention.

The aforementioned copolymer preferably has a glass transition temperature of from 50 to 70° C.

The polymerizable monomers constituting the copolymer resin will be described.

Examples of the styrene monomer include styrene, α-methylstyrene, vinylnaphthalene, an alkyl-substituted styrene having an alkyl chain, such as 2-methylstyrene, 3-methylstyrene, 4-methylstyrene, 2-ethylstyrene, 3-ethylstyrene and 4-ethylstyrene, a halogen-substituted styrene, such as 2-chlorostyrene, 3-chlorostyrene and 4-chlorstyrene, and a fluorine-substituted styrene, such as 4-fluorostyrene and 2,5-difluorostyrene. The styrene monomer is preferably styrene.

Examples of the (meth)acrylate monomer include n-methyl (meth)acrylate, n-ethyl (meth)acrylate, n-propyl (meth) acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth) acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acryalte, t-butyl (meth)acrylate, isopentyl (meth)acrylate, amyl (meth)acrylate, neopentyl (meth)acrylate, isohexyl (meth) acrylate, isoheptyl (meth)acrylate, isooctyl (meth)acrylate, 2-ethylhexyl (meth)acrylate, phenyl (meth)acrylate, biphenyl (meth)acrylate, diphenylethyl (meth)acrylate, t-butylphenyl (meth)acrylate, terphenyl (meth)acrylate, cyclohexyl (meth)acrylate, t-butylcyclohexyl (meth)acrylate, dimethylaminoethyl (meth)acrylate, diethylaminoethyl (meth)acrylate, methoxyethyl (meth)acrylate, 2-hydroxyethyl (meth)acrylate, β-carboxyethyl (meth)acrylate, (meth) acrylonitrile and (meth)acrylamide. The (meth)acrylate monomer is preferably n-butyl acrylate.

The ethylenic unsaturated acid monomer is an ethylenic unsaturated monomer having an acidic group, such as a carboxyl group, a sulfonic acid group and an acid anhydride group.

In the case where a carboxyl group is added to the styrene resin, the (meth)acryalte resin and the styrene-(meth)acrylate copolymer resin, a polymerizable monomer having a carboxyl group may be copolymerized.

Specific examples of the carboxyl group-containing polymerizable monomer include acrylic acid, aconitic acid, atropic acid, allylmalonic acid, angelic acid, isocrotonic acid, itaconic acid, 10-undecenic acid, elaidic acid, erucic acid, oleic acid, o-carboxycinnamic acid, crotonic acid, chloroacrylic acid, chloroisocrotonic acid, chlorocrotonic acid, chlorofumaric acid, chloromaleic acid, cinnamic acid, cyclohexenedicarboxylic acid, citraconic acid, hydroxycinnamic acid, 4-phenyl-3-butenic acid, ferulic acid, fumaric acid, brassidic acid, 2-(2-furil)acrylic acid, bromocinnamic acid, bromofumaric acid, bromomaleic acid, benzylidenemalonic acid, benzoylacrylic acid, 4-pentenic acid, maleic acid, mesaconic acid, methacrylic acid, methylcinnamic acid and methoxycinnamic acid. From the standpoint of easiness in polymer forming reaction, acrylic acid, methacrylic acid, maleic acid, cinnamic acid and fumaric acid are preferred, and acrylic acid is more preferred.

The binder resin used in the toner of the invention may be polymerized using a chain transfer agent. The chain transfer agent is not particularly limited, and a compound having a thiol component may be used. Specifically, an alkylmercaptan, such as hexylmercaptan, heptylmercaptan, octylmercaptan, nonylmercaptan, decylmercaptan and dodecylmercaptan, are preferred. The use of these chain transfer agents is preferred since the molecular weight distribution becomes narrow to improve the storage stability of the toner at a high temperature.

The binder resin used in the invention may be added with a crosslinking agent depending on necessity. Representative examples of the crosslinking agent include a polyfunctional monomer having two or more ethylenic polymerizable unsaturated groups in one molecule.

Specific examples of the crosslinking agent include an aromatic polyvinyl compound, such as divinylbenzene and divinylnaphthalene; a polyvinyl ester of an aromatic polyvalent carboxylic acid, such as divinyl phthalate, divinyl isophthalate, divinyl terephthalate, divinyl homophthalate, divinyl/trivinyl trimesate, divinyl naphthalenedicarboxylate and divinylbiphenylcarboxylate; a divinyl ester of a nitrogen-containing aromatic compound, such as divinyl pyridinedicarboxylate; a vinyl ester of an unsaturated heterocyclic compound, such as vinyl pyrromucinate, vinyl furancarboxylate, vinyl pyrrol-2-carboxylate and vinyl thiophenecarboxylate; a (meth)acrylate ester of a linear polyvalent alcohol, such as butanediol methacrylate, hexanediol acrylate, octanediol methacrylate, decanediol acrylate and dodecanediol methacrylate; a (meth)acrylate ester of a branched or substituted polyvalent alcohol, such as neopentylglycol dimethacrylate and 2-hydroxy-1,3-diacryloxypropane; a (meth)acrylate ester of a polyalkylene glycol, such as polyethylene glycol di(meth)acrylate and polypropylene polyethylene glycol di(meth)acrylate; and a polyvinyl ester of a polyvalent carboxylic acid, such as divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, divinyl dodecanedicarboxylate and divinyl brassylate.

In the invention, the crosslinking agent may be used solely or in combination of two or more kinds thereof. Preferred examples of the crosslinking agent in the invention among the aforementioned crosslinking agents include a (meth)acrylate ester of a linear polyvalent alcohol, such as butanediol methacrylate, hexanediol acrylate, octanediol methacrylate, decanediol acrylate and dodecanediol methacrylate; a (meth)acrylate ester of a branched or substituted polyvalent alcohol, such as neopentylglycol dimethacrylate and 2-hydroxy-1,3-diacryloxypropane; and a (meth)acrylate ester of a polyalkylene glycol, such as polyethylene glycol di(meth)acrylate and polypropylene polyethylene glycol di(meth)acrylate.

The content of the crosslinking agent is preferably from 0.05 to 5% by mass, and more preferably from 0.1 to 1.0% by mass, based on the total amount of the polymerizable monomers.

Among the binder resins that can be used in the toner of the invention, those capable of being produced by radical polymerization of a polymerizable monomer can be polymerized by using a radical polymerization initiator.

The radical polymerization initiator used herein is not particularly limited. Specific examples thereof include a peroxide compound, such as hydrogen peroxide, acetyl peroxide, cumyl peroxide, tert-butyl peroxide, propyonyl peroxide, benzoyl peroxide, chlorobenzoyl peroxide, dichlorobenzoyl peroxide, bromomethylbenzoyl peroxide, lauroyl peroxide, ammonium peroxide, sodium peroxide, potassium peroxide, diisopropyl peroxycarbonate, tetralin hydroperoxide, 1-phenyl-2-methylpropyl-1-hydroperoxide, tert-butyl pertriphenylacetate hydroperoxide, tert-butyl performate, tert-butyl perbenzoate, tert-butyl perphenylacetate, tert-butyl permethoxyacetate and tert-butyl per-N-(3-toluyl) carbamate, an azo compound, such as 2,2'-azobispropane, 2,2'-dichloro-2,2'-azobispropane, 1,1'-azo(methylethyl) diacetate, 2,2'-azobis(2-amidinopropane) hydrochloride, 2,2'-azobis(2-amidinopropane) nitrate, 2,2'-azobisisobutane, 2,2'-azobisisobutylamide, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyano valeric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A-4,4'-azobis-4-cyanopentanoate) and poly(tetraethylene glycol-2,2'-azobisisobutyrate), 1,4-bis(pentaethylene)-2-tetrazene and 1,4-dimethoxycarbonyl-1,4-diphenyl-2-tetrazene.

(Surfactant)

Upon producing the toner of the invention, a surfactant may be used, for example, for stabilization on dispersing in the suspension polymerization method, and stabilization of the dispersed state of the resin particle dispersion liquid, the colorant dispersion liquid and the releasing agent dispersion liquid in the emulsion polymerization aggregation method.

Examples of the surfactant include an anionic surfactant, such as a sulfate ester compound, a sulfonate ester compound, a phosphate ester compound and a soap compound; a cationic surfactant, such as an amine salt compound and a quaternary ammonium salt compound; and a nonionic surfactant, such as a polyethylene glycol compound, an alkylphenol ethyleneoxide adduct, and a polyvalent alcohol. Among these, an ionic surfactant is preferred, and an anionic surfactant and a cationic surfactant are more preferred.

In the toner of the invention, an anionic surfactant is advantageously used for dispersing the releasing agent because an anionic surfactant generally has a large dispersing power and is excellent for dispersing the resin particles and the colorant.

A nonionic surfactant is preferably used in combination with the anionic surfactant or the cationic surfactant. The surfactant may be used solely or in combination of two or more kinds thereof.

Specific examples of the anionic surfactant include a fatty acid soap compound, such as potassium laurate, sodium oleate and sodium caster oil, a sulfate ester compound, such as octyl sulfate, lauryl sulfate, lauryl ether sulfate and nonylphenyl ether sulfate, lauryl sulfonate, dodecylbenzene sulfonate, sodium alkylnaphthalenesulfonate, such as triisopropylnaphthalene sulfonate and dibutylnaphthalene sulfonate, naphthalene sulfonate formalin condensate, monooctyl sulfosuccinate, dioctyl sulfosuccinate, a sulfonate salt compound, such as lauric acid amidesulfonate and oleic acid amidesulfonate, a phosphate ester compound, such as lauryl phosphate, isopropyl phosphate and nonylphenyl ether phosphate, a dialkyl sulfosuccinate salt compound, such as sodium dioctyl sulfosuccinate, and a sulfosuccinate salt compound, such as disodium lauryl sulfosuccinate.

Specific examples of the cationic surfactant include an amine salt, such as laurylamine hydrochloride, stearylamine hydrochloride, oleylamine acetate, stearylamine acetate and stearylaminopropylamine acetate; and a quaternary ammonium salt, such as lauryltrimethylammonium chloride, dilauryldimethylammonium chloride, distearyldimethylammonium chloride, distearyldimethylammonium chloride, lauryldihydroxyethylmethylammonium chloride, oleylbispolyoxyethylenemethylammonium chloride, lauloylaminopropylmethylethylammonium ethosalfate, lauroylaminopropyldimethylhydroxyethylammonium perchlorate, alkylbenzenetrimethylammonium chloride and alkyltrimethylammonium chloride.

Specific examples of the nonionic surfactant include an alkyl ether, such as polyoxyethylene octyl ether, polyoxyethylene lauryl ether, polyoxyethylene allyl ether and polyoxyethylene oleyl ether; an alkylphenyl ether, such as polyoxyethylene octylphenyl ether and polyoxyethylene nonylphenyl ether; an alkyl ester, such as polyoxyethylene laurate, polyoxyethylene stearate and polyoxyethylene oleate; an alkylamine, such as polyoxyethylene laurylamino ether, polyoxyethylene stearylamino ether, polyoxyethylene oleylamino ether, polyoxyethylene soybean amino ether and polyoxyethylene tallow amino ether; an alkylamide, such as polyoxyethylene lauric acid amide, polyoxyethylene stearic acid amide and polyoxyethylene oleic acid amide; a vegetable oil ether, such as polyoxyethylene ricinus ether and polyoxyethylene rapeseed oil ether; an alkanol amide, such as lauric acid diethernaolamide, stearic acid diethanolamide and oleic acid diethanolamide; and a sorbitan ester ether, such as polyoxyethylene sorbitan monolaurate, polyoxyethylene sorbitan monopalmitate, polyoxyethylene sorbitan monostearate and polyoxyethylene sorbitan monooleate.

The content of the surfactant in the dispersion liquids may be such an amount that does not impair the effect of the invention, and is generally a small amount, specifically, from 0.01 to 3% by mass, more preferably from 0.05 to 2% by mass, and further preferably from 0.1 to 1% by mass. In the case where the content is in the aforementioned range, the dispersion liquids, e.g., the resin particle dispersion liquid, the colorant dispersion liquid and the releasing agent dispersion liquid, are stable to cause no aggregation or isolation of particular kind of particles, and do not adversely affect the addition amount of the copper compound, whereby the effect of the invention can be sufficiently exerted. In general, a toner dispersion liquid having a large particle diameter obtained by suspension polymerization is stable with a small amount of a surfactant used.

(Dispersion Stabilizer)

As a dispersion stabilizer that can be used in the suspension polymerization, hydrophilic and water-insoluble inorganic fine particles may be used. Examples of the inorganic particles that can be used include silica, alumina, titania, calcium carbonate, magnesium carbonate, tricalcium phosphate (hydroxyapatite), clay, diatom earth and bentonite. Among these, calcium carbonate and tricalcium phosphate are preferred owing to easiness in formation of fine particles and removal.

An aqueous polymer that is solid at ordinary temperature may also be used as the dispersion stabilizer. Specific examples thereof include a cellulose compound, such as carboxymethyl cellulose and hydroxypropyl cellulose, polyvinyl alcohol, gelatin, starch and gum arabic.

(Charge Controlling Agent)

A charge controlling agent may be added to the toner of the invention depending on necessity.

Known charge controlling agents can be used in the invention, and for example, an azo metallic complex, a salicylic acid metallic complex and a resin type charge controlling agent having a polar group may be used. In the case where the toner is produced by a wet process, a material that is hardly soluble in water is preferably used for controlling the ion intensity and reducing contamination due to waste water. The toner of the invention may be either a magnetic toner containing a magnetic material encompassed therein or a non-magnetic toner containing no magnetic material.

(Aggregating Agent)

In the case where the toner of the invention is produced by the emulsion polymerization aggregation method, aggregation may be induced in the aggregating step by changing the pH or the like, so as to produce particles having a toner diameter containing the binder resin and the colorant. In the aggregating step, an aggregating agent may be added in order to stably and quickly induce the aggregation or to obtain aggregated particles having a narrow particle diameter distribution.

As the aggregating agent, a compound having monovalent or higher valent compound, and specific examples thereof include the aforementioned water soluble surfactants, such as an ionic surfactant and a nonionic surfactant, an acid, such as hydrochloric acid, sulfuric acid, nitric acid, acetic acid and oxalic acid, a metallic salt of an inorganic acid, such as magnesium chloride, sodium chloride, aluminum sulfate, calcium sulfate, ammonium sulfate, aluminum nitrate, silver nitrate, copper sulfate and sodium carbonate, a metallic salt of an aliphatic acid or an aromatic acid, such as sodium acetate, potassium formate, sodium oxalate, sodium phthalate and potassium salicylate, a metallic salt of a phenol compound, such as sodium phenolate, a metallic salt of an amino acid, and an inorganic acid salt of an aliphatic or aromatic amine, such as triethanolamine hydrochlorate and aniline hydrochlorate.

A metallic salt of an inorganic acid is preferably used as the aggregating agent under consideration of performance in stability of aggregated particles, stability of the aggregating agent against heat and lapse of time, and removal upon washing. Specific examples of the metallic salt of an inorganic acid include magnesium chloride, sodium chloride, aluminum sulfate, calcium sulfate, ammonium sulfate, aluminum nitrate, silver nitrate, copper sulfate and sodium carbonate.

The addition amount of the aggregating agent may be a small amount while depending on the valency thereof, and is generally 3% by mass or less for a monovalent compound, 1% by mass or less for a divalent compound, and 0.5% by mass or less for a trivalent compound. The amount of the aggregating agent is preferably as small as possible, and thus a compound having higher valency is preferably used.

(Other Colorants for Toner)

A colorant used in the invention in addition to the magenta colorant and the yellow colorant mentioned hereinabove is not particularly limited, and the known colorants may be used after appropriately selecting depending on purposes. A colorant may be used solely, or two or more kinds of colorants of the same series maybe used in combination. Two or more kinds of colorants of the different series may be used as a mixture. The colorant may be subjected to a surface treatment.

Specific examples of the colorant include the following pigments and dyes.

Examples of a black pigment include such organic colorants as Aniline Black.

Examples of a green pigment include such organic colorants as Chrome Green, Pigment Green B, Malachite Green Lake and Final Yellow Green G.

Examples of a blue pigment include such organic colorants as Iron Blue, Cobalt Blue, Alkali Blue Lake, Victoria Blue Lake, Fast Sky Blue, Indanthrene Blue BC, Ultramarine Blue, Phthalocyanine Blue and Phthalocyanine Green.

Examples of a violet pigment include such organic colorants as Manganese Violet, Fast Violet B and Methyl Violet Lake.

Examples of a dye include various dyes, such as basic, acidic, disperse and direct dyes, for example, nigrosine, Methylene Blue, Rose Bengal and Quinoline Yellow.

In the case where the colorant is of black, green or violet color, such an advantage is obtained that the addition amount of the copper compound can be increased without large influence on the color tone of the toner because these colors are the same series as the copper compound or are dark colors.

Therefore, in the case where a colorant of black, green, blue or violet color is used, the copper compound may be added in the following larger amount.

$$-3.0 \leqq \log_{10}\{[Cu]/[C]\} \leqq -1.0$$

wherein [C] represents a carbon content (%) and [Cu] represents a copper content (%).

(Method of Dispersing Colorant)

The colorant used in the toner of the invention can be dispersed in the binder resin by the known method. In the case where the toner is produced by the kneading and pulverizing method, the colorant may be used as it is, may be used by the master batch system, in which the colorant is previously mixed with a resin in a high concentration to prepare a master batch, and the master batch is mixed with the binder resin upon kneading, or may be used by the flashing system, in which the colorant thus synthesized in the form of a wet cake before drying is dispersed in the resin.

The colorant may be used as it is for producing the toner by the suspension polymerization method, in which the colorant dispersed in a resin is dissolved or dispersed in a polymerizable monomer, whereby the colorant can be dispersed in the particles thus formed.

In the case where the toner is produced by the emulsion polymerization aggregation method, the colorant is dispersed in an aqueous medium along with a dispersant, such as a surfactant, by applying mechanical impacts, so as to produce a colorant dispersion liquid, and the colorant dispersion liquid is aggregated with the binder resin particles and the other components to the toner diameter, whereby the toner can be produced.

Specific examples of the method of dispersing the colorant by mechanical impacts include a media dispersing machine, such as a rotation shearing homogenizer, a ball mill, a sand mill and an attritor, and a high pressure counter collision dispersing machine, by which the dispersion liquid of the colorant can be prepared. The colorant can also be dispersed in an aqueous medium with a homogenizer by using a surfactant having polarity.

In order to ensure the coloring property upon fixing, the colorant is preferably added to the toner in an amount of from 4 to 15% by mass, and more preferably from 4 to 10% by mass, based on the total solid content of the toner. In the case where a magnetic material is used as a black colorant, the addition amount thereof is preferably from 12 to 48% by mass, and more preferably from 15 to 40% by mass. Various kinds of toners, such as a yellow toner, a magenta toner, a cyan toner, a black toner, a white toner and a green toner, can be obtained by appropriately selecting the kind of the colorants.

(Releasing Agent)

A releasing agent may be added to the toner of the invention depending on necessity. The releasing agent is generally used for improving the releasing property. Specific examples of the releasing agent include a low molecular weight polyolefin compound, such as polyethylene, polypropylene and polybutene; a silicone compound having a softening point upon heating; an aliphatic acid amide, such as oleic acid amide, erucic acid amide, ricinoleic acid amide and stearic acid amide; vegetable wax, such as carnauba wax, rice wax, candelilla wax, haze wax and jojoba oil; animal wax, such as bees wax, mineral or petroleum wax, such as montan wax, ozokerite, ceresin, paraffin wax, microcrystalline wax and Fischer-Tropsch wax, and ester wax, such as a fatty acid ester, a montanate ester and a caroxylate ester. In the invention, the releasing agent may be used solely or combination of two or more kinds thereof.

The addition amount of the releasing agent is preferably from 1 to 20% by mass, and more preferably from 5 to 15% by mass, based on the total amount of the toner particles. In the case where the amount of the releasing agent is in the aforementioned range, the effect of the releasing agent can be sufficiently exerted. Furthermore, not only the copper compound can be uniformly dispersed in the toner, but also the toner particles are difficult to be broken in the developing device, whereby the releasing agent is not spent to the carrier, and the charging property is not lowered.

(Internal Additive)

An internal additive may be added to the interior of the toner of the invention. The internal additive is generally used for controlling viscoelasticity of the fixed image. Specific examples of the internal additive include inorganic fine particles, such as silica and titania, and organic fine particles, such as polymethyl methacrylate, which may be subjected to a surface treatment for improving the dispersibility thereof. The internal additive may be used solely or in combination of two or more kinds thereof.

(External Additive)

An external additive, such as a fluidizing agent and a charge controlling agent, may be added to the toner of the invention. The external additive may be the known materials, and examples of the external additive include inorganic fine particles having been treated with a silane coupling agent on the surface thereof, such as silica fine particles, titanium oxide fine particles, alumina fine particles, cerium oxide fine particles and carbon black, polymer fine particles, such as polycarbonate, polymethyl methacrylate and a silicone resin, a metallic amine salt, and a metallic salicylate salt. The external additive may be used solely or in combination of two or more kinds thereof.

(Carrier)

The toner of the invention may be used as it is as a one-component developer used with a developing device having a charge imparting mechanism, and also may be used as a two-component developer in the form of a mixture of the toner and a carrier. The carrier is preferably a coated carrier containing a core material, such as iron powder, coated with a resin. The core material (carrier core material) used is not particularly limited, and examples thereof include a magnetic metal, such as iron, steel, nickel and cobalt, a magnetic oxide, such as ferrite and magnetite, and glass beads. A magnetic carrier is preferably used from the standpoint of use of the magnetic brush method. The average particle diameter of the carrier core material is preferably from 3 to 10 times the average diameter of the toner.

Examples of the coated resin include an acrylic resin, a styrene resin, an amino resin including urea, urethane, melamine, guanamine and aniline, an amide resin and a urethane resin. A copolymer resin of these resins may be used. Two or more kinds of these resins may be used in combination as the coated resin of the carrier. Resin fine particles or inorganic fine particles maybe dispersed in the coated resin for controlling the charging property.

Examples of the method of coating the resin coated layer on the surface of the carrier core material include the dipping method of dipping the carrier core material in a solution for forming a coated layer, the spray method of spraying a solution for forming a coated layer on the surface of the carrier core material, a fluidized bed method of spraying a solution for forming a coated layer on the carrier core material floated with fluidizing air flow, a kneader-coater method of mixing the carrier core material and a solution for forming a coated layer in a kneader-coater, followed by removing the solvent, and a powder coating method of mixing the finely powdered resin with the carrier core material at a temperature higher than the melting point of the resin, followed by cooling to coat the resin, and the kneader-coater method and the powder coating method are preferably employed.

The coated amount of the resin formed by the aforementioned methods is generally from 5 to 10% by mass based on the carrier core material. The mixing ratio (weight ratio) of the toner and the carrier (toner/carrier) is generally from 1/100 to 30/100, and preferably from 3/100 to 20/100.

(Process for Forming Image)

The process for forming an image of the invention contains charging a surface of an electrostatic latent image carrier (photoreceptor) with a charging unit; exposing the charged electrostatic latent image carrier by irradiating a light image corresponding to image information to form a latent image on the electrostatic latent image carrier; developing the latent image on the electrostatic latent image carrier with an electrophotographic developer containing a toner to form a toner image; transferring the toner image to a transfer material; and fixing the toner image. The respective steps themselves are those ordinary in the art and described, for example, in JP-A-56-40868 and JP-A-49-91231. The process for forming an image of the invention can be practiced by using a known image forming apparatus, such as a duplicator and a facsimile machine.

The charging system is not particularly limited and may be a non-contact charging system, such as corotron and scorotron, and a contact charging system, and a contact charging system is preferably used owing to the small ozone generation amount.

The formation of an electrostatic latent image can be attained by exposing the uniformly charged surface of the electrostatic latent image carrier with an exposing unit, such as a laser optical system and an LED array, so as to form an electrostatic latent image. The exposing system is not particularly limited in the invention.

The transferring step is to transfer the toner image to a transfer material. Examples of the transfer material include transfer paper, as well as an intermediate transfer drum and an intermediate transfer belt, which are used for forming a color image.

In the fixing step, the toner image thus transferred to a fixing material, such as transfer paper, is fixed thereto by heating with fixing members, and specifically, the fixing material, such as fixing paper, is passed between two fixing members, by which the toner image on the fixing material is fixed by heat-melting. The fixing members are in a form of a roll or a belt, and at least one of them has a heating device. The fixing members may be a roll or a belt as it is or may be coated with a resin on the surface thereof.

A fixing roll can be produced by coating silicone rubber, Viton rubber or the line on a surface of a roll core material.

A fixing belt may be formed with polyamide, polyimide, polyethylene terephthalate, polybutyrene terephthalate or the like, which may be used solely or in combination of two or more of them. Examples of the resin coated on the roll and the belt include homopolymers and copolymers of a styrene compound, such as styrene, p-chlorostyrene and α-methylstyrene, an α-methylene aliphatic acid monocarboxylate compound, such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate, a nitrogen-containing acrylic compound, such as dimethylaminoethyl methacrylate, a vinylnitrile compound, such as acrylonitrile and methacrylonitrile, a vinylpyridine compound, such as 2-vinylpyridine and 4-vinylpyridine, a vinyl ether compound, such as vinyl methyl ether and vinyl isobutyl ether, a vinyl ketone compound, such as vinyl methyl ketone, vinyl ethyl ketone and vinyl isopropenyl ketone, an olefin compound, such as ethylene and propylene, and a fluorine-containing vinyl monomer, such as vinylidene fluoride, tetrafluoroethylene and hexafluoroethylene, a silicone compound, such as methyl silicone and methylphenyl silicone, a polyester compound containing bisphenol and glycol, an epoxy resin, a polyurethane resin, a polyamide resin, a cellulose resin, a polyether resin and a polycarbonate resin. These resins may be used solely or in combination of two or more kinds thereof. Specific examples thereof include polytetrafluoroethylene, a homopolymer and/or a copolymer of a fluorine-containing compound, such as vinylidene fluoride and ethylene fluoride, and a homopolymer and/or copolymer of an unsaturated hydrocarbon, such as ethylene and propylene.

A transfer material, to which the toner is fixed, may be paper, a resin film or the like. The fixing paper may be coated paper having a resin coated on a part or the entire surface of paper. The resin film for fixing may be a resin coated film having another resin coated on a part or the entire surface thereof. Resin fine particles or inorganic fine particles may be added to the transfer material for preventing duplicated feed of the transfer material due to friction of the paper and the resin film and/or electrostatic charge caused by the friction, and for preventing deterioration in adhesion of the fixed image due to the releasing agent exuded on the interface between the transfer material and the fixed image upon fixing.

Specific examples of the resin coated on the paper and the resin film include homopolymers and copolymers of a styrene compound, such as styrene, p-chlorostyrene and α-methylstyrene, an α-methylene aliphatic acid monocarboxylate compound, such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate, a nitrogen-containing acrylic compound, such as dimethylaminoethyl methacrylate, a vinylnitrile compound, such as acrylonitrile and methacrylonitrile, a vinylpyridine compound, such as 2-vinylpyridine and 4-vinylpyridine, a vinyl ether compound, such as vinyl methyl ether and vinyl isobutyl ether, a vinyl ketone compound, such as vinyl methyl ketone, vinyl ethyl ketone and vinyl isopropenyl ketone, an olefin compound, such as ethylene and propylene, and a fluorine-containing vinyl monomer, such as vinylidene fluoride, tetrafluoroethylene and hexafluoroethylene, a silicone compound, such as methyl silicone and methylphenyl silicone, a polyester compound containing bisphenol and glycol, an epoxy resin, a polyurethane resin, a polyamide resin, a cellulose resin, a polyether resin and a polycarbonate resin. These resins may be used solely or in combination of two or more kinds thereof.

Specific examples of the inorganic fine particles include any kind of particles that are ordinarily used as an external additive to a toner surface, such as silica, titania, calcium carbonate, magnesium carbonate, tricalcium phosphate and cerium oxide. Examples of the resin fine particles include any kind of particles that are ordinarily used as an external additive to a toner surface, such as a vinyl resin, a polyester resin and a silicone resin. The inorganic particles and the resin particles may be also used as a fluidizing assistant.

EXAMPLE

The invention will be described in detail with reference to the following examples, but the invention is not construed as being limited thereto. In the following examples, all "parts" mean "parts by weight" unless otherwise indicated.

(Method of Measuring Particle Diameter and Particle Diameter Distribution)

The particle diameter (sometimes referred to as "particle size") and the particle diameter distribution (sometimes referred to as "particle size distribution") in the invention will be described.

In the case where a particle diameter to be measured in the invention is 2 μm or more, a Coulter Counter, Model TA-II (produced by Beckman Coulter, Inc.) is used as a measuring apparatus with ISOTON-II (produced by Beckman Coulter, Inc.) as an electrolytic solution.

Upon measurement, from 0.5 to 50 mg of a specimen to be measured is added to a surfactant, preferably 2 mL of a 5% aqueous solution of sodium alkylbenzenesulfonate, and the mixture is added to 100 mL of the aforementioned electrolytic solution.

The electrolytic solution having the specimen suspended therein is dispersed with an ultrasonic dispersing apparatus for 1 minute and measured with the aforementioned Coulter Counter, Model TA-II, with an aperture having an aperture diameter of 100 μm for the particle size distribution of from 2 to 60 μm to obtain a volume average distribution and a number average distribution. The number of particles to be measured is 50,000.

The particle size distribution of the toner of the invention is obtained in the following manner. With respect to the particle size ranges (channels) obtained by dividing the particle size distribution thus measured, an accumulated volume distribution is drawn from the smaller particle diameter side. The accumulated number diameter for an accumulation of 16% is designated as D16p, the accumulated volume diameter for an accumulation of 50% is designated as D50v, and the accumulated number diameter for an accumulation of 84% is designated as D84p.

The volume average particle diameter in the invention is the value of D50v, and the value GSDp is calculated by the following equation.

$$GSDp=\{(D84p)/(D16p)\}^{0.5}$$

In the case where a particle diameter to be measured in the invention is less than 2 μm, a laser diffraction particle size measuring apparatus (LA-700, produced by Horiba, Ltd.) is used as a measuring apparatus. Upon measurement, a specimen in the form of a dispersion liquid to be measured is adjusted to a solid content of the specimen of about 2 g, to which ion exchanged water is added to make about 40 mL. The specimen dispersion is placed in a cell to an appropriate concentration, and the particle diameter distribution is measured after lapsing 2 minutes for stabilizing the concentration in the cell. The volume average particle diameters for the respective channels thus obtained are accumulated from the smaller diameter side, and a value for an accumulation of 50% is designated as the volume average particle diameter.

In the case where powder of an external additive is measured, 2 g of the specimen to be measured is added to a surfactant, preferably 50 mL of a 5% aqueous solution of sodium alkylbenzenesulfonate, and the mixture is dispersed with an ultrasonic dispersing apparatus (1,000 Hz) for 2 minutes to prepare a sample, which is then measured in the same manner as for the aforementioned dispersion liquid.

(Measurement of Shape Factor SF1 of Toner)

The shape factor SF1 of the toner is a shape factor SF indicating the extent of unevenness on the surface of the toner particles and can be calculated by the following equation.

$$SF = \frac{(ML)^2}{A} \times \frac{100}{4\pi}$$

In the equation, ML represents the circumferential length of the toner particle, and A represents the projected area of the particle.

Upon measurement, an optical micrograph of the toner scattered on a slide glass is incorporated into an image analyzer through a video camera, and the SF is calculated for 50 or more toner particles for obtaining an average value thereof.

(Molecular Weight and Molecular Weight Distribution of Toner and Resin Particles)

The molecular weight distribution of the toner for developing an electrostatic latent image of the invention is measured under the following conditions. A gel permeation chromatography (GPC) apparatus (HLC-8129GPC, SC-8020, produced by Tosoh Corp.) is used with two columns (TSK gel, Super HM-H, produced by Tosoh Corp., 6.0 mm ID×15 cm), and THF (tetrahydrofuran) is used as an eluant. The measurement conditions are a specimen concentration of 0.5%, a flow rate of 0.6 mL/min, a sample injection amount of 10 μL, and a measurement temperature of 40° C., with an IR detector. The calibration curve used is prepared by using 10 samples of the polystyrene standard sample, TSK Standard, produced by Tosoh Corp., A-500, F-1, F-10, F-80, F-380, A-2500, F-4, F-40, F-128 and F-700.

(Measurement of Melting Point of Releasing Agent and Glass Transition Temperature of Toner)

The melting point of the releasing agent used in the toner of the invention and the glass transition temperature of the toner are determined by the DSC (differential scanning calorimeter) measuring method, and obtained from a major maximum peak measured according to ASTM D3418-8.

The measurement of the major maximum peak can be carried out with DSC-7, produced by Perkin-Elmer, Inc. The temperature compensation of the detector of the apparatus is carried out by using the melting points of indium and zinc, and the heat quantity compensation thereof is carried out by using the melting heat of indium. The specimen to be measured is placed on an aluminum pan with a blank pan for control, and the measurement is carried out at a temperature increasing rate of 10° C. per minute.

(Acid Value of Resin)

The acid values of the binder resin and the toner are measured according to the potentiometric titration method of JIS K0070-1992.

(Fluorescent X-ray Measurement)

As a pre-treatment, 6 g of the toner to be measured is molded under pressure at 10 t for 1 minute in a pressure molding machine.

The molded toner is measured by using a fluorescent X-ray apparatus XRF-1500, produced by Shimadzu Corp., under measuring conditions of an X-ray eddy voltage of 40 kV, an X-ray eddy current of 90 mA and a measuring time of 30 minutes.

(Effect of Addition of Copper Compound)

(Preparation of Binder Resin Particle Dispersion Liquid (1))

| | |
|---|---|
| Styrene | 296 parts |
| n-Butyl acrylate | 104 parts |
| Acrylic acid | 6 parts |
| Dodecane thiol | 10 parts |
| Divinyl adipate | 1.6 parts |

(all produced by Wako Pure Chemical Industries, Ltd.)

A mixture of the aforementioned components dissolved with each other is added to a solution obtained by dissolving 12 parts of a nonionic surfactant (Nonipol 400, produced by Sanyo Chemical Industries, Ltd.) and 8 parts of an anionic surfactant (Neogen SC, produced by Daiich Kogyo Seiyaku Co., Ltd.) in 550 parts of ion exchanged water, and dispersed and emulsified in a flask. 61 parts of ion exchanged water having 8 parts of ammonium persulfate (produced by Wako Pure Chemical Industries, Ltd.) dissolved therein is added to the mixture under slowly stirring over 10 minutes, and then substituted with nitrogen for 20 minutes at 0.1 L/min. Thereafter, the mixture in the flask is heated over an oil bath to 70° C. under stirring, and emulsion polymerization is continued for 5 hours, so as to prepare a binder resin particle dispersion liquid (1) having an average particle diameter of 200 nm and a solid content of 41%. A part of the dispersion liquid is allowed to stand on an oven at 100° C. to remove water, and measured with a DSC (differential scanning calorimeter). The binder resin particles have a glass transition temperature of 53° C. and a weight average molecular weight of 30,000.

(Preparation of Colorant Dispersion Liquid (1))

| | |
|---|---|
| C.I. Pigment Yellow 74 (monoazo pigment) (Seika Fast Yellow 2054, produced by Dainichiseika Color and Chemicals Mfg Co., Ltd.) | 100 parts |
| Anionic surfactant (Neogen SC, produced by Diich Kogyo Seiyaku Co., Ltd.) | 10 parts |
| Ion exchanged water | 390 parts |

The aforementioned components are mixed and dissolved with each other, and the mixture is dispersed in a homogenizer (Ultra-Turrax, produced by IKA Works, Inc.) for 10 minutes to obtain a colorant dispersion liquid (1).

(Preparation of Colorant Dispersion Liquid (2))

A colorant dispersion liquid (2) is prepared in the same manner as in the preparation of the colorant dispersion liquid (1) except that the colorant is changed to C.I. Pigment Yellow 402 (benzimidazolone pigment, KET Yellow 402, produced by Dainippon Ink & Chemicals, Inc.).

(Preparation of Colorant Dispersion Liquid (3))

A colorant dispersion liquid (3) is prepared in the same manner as in the preparation of the colorant dispersion liquid (1) except that the colorant is changed to C.I. Pigment Yellow 93 (disazo condensation pigment, Chromofine Yellow 5930, produced by Dainichiseika Color and Chemicals Mfg Co., Ltd.).

(Preparation of Colorant Dispersion Liquid (4))

A colorant dispersion liquid (4) is prepared in the same manner as in the preparation of the colorant dispersion liquid (1) except that the colorant is changed to C.I. Pigment Yellow 110 (isoindolinone pigment, Fastogen Super Yellow GRD, produced by Dainippon Ink & Chemicals, Inc.).

(Preparation of Colorant Dispersion Liquid (5))

A colorant dispersion liquid (5) is prepared in the same manner as in the preparation of the colorant dispersion liquid (1) except that the colorant is changed to C.I. Pigment Yellow 193 (anthraquinone pigment, Chromofine Yellow AF-1300, produced by Dainichiseika Color and Chemicals Mfg Co., Ltd.).

(Preparation of Colorant Dispersion Liquid (6))

A colorant dispersion liquid (6) is prepared in the same manner as in the preparation of the colorant dispersion liquid (1) except that the colorant is changed to C.I. Pigment Yellow 17 (disazo pigment, KET Yellow 403, produced by Dainippon Ink & Chemicals, Inc.).

(Preparation of Colorant Dispersion Liquid (7))

A colorant dispersion liquid (7) is prepared in the same manner as in the preparation of the colorant dispersion liquid (1) except that the colorant is changed to C.I. Pigment Yellow 139 (isoindolinone pigment, Paliotol Yellow L1820, produced by BASF, Ltd.)

(Preparation of Colorant Dispersion Liquid (8))

A colorant dispersion liquid (8) is prepared in the same manner as in the preparation of the colorant dispersion liquid (1) except that the colorant is changed to C.I. Pigment Yellow 138 (quinophthalone pigment, Paliotol Yellow L0960HD, produced by BASF, Ltd.)

(Preparation of Colorant Dispersion Liquid (9))

A colorant dispersion liquid (9) is prepared in the same manner as in the preparation of the colorant dispersion liquid (1) except that the colorant is changed to C.I. Pigment Red 122 (anthraquinone pigment, Chromofine Magenta 6887, produced by Dainichiseika Color and Chemicals Mfg Co., Ltd.).

(Preparation of Colorant Dispersion Liquid (10))

A colorant dispersion liquid (10) is prepared in the same manner as in the preparation of the colorant dispersion liquid (1) except that the colorant is changed to C.I. Pigment Red 22 (β-naphthol pigment, KET Red 302, produced by Dainippon Ink & Chemicals, Inc.).

(Preparation of Colorant Dispersion Liquid (11))

A colorant dispersion liquid (11) is prepared in the same manner as in the preparation of the colorant dispersion liquid (1) except that the colorant is changed to C.I. Pigment Red 57:1 (azo lake pigment, KET Red 306, produced by Dainippon Ink & Chemicals, Inc.).

(Preparation of Colorant Dispersion Liquid (12))

A colorant dispersion liquid (12) is prepared in the same manner as in the preparation of the colorant dispersion liquid (1) except that the colorant is changed to C.I. Pigment Red 37 (disazo pigment, Maroon HFM01, produced by Clariant Japan Co., Ltd.).

(Preparation of Colorant Dispersion Liquid (13))

A colorant dispersion liquid (13) is prepared in the same manner as in the preparation of the colorant dispersion liquid (1) except that the colorant is changed to C.I. Pigment Red 185 (benzimidazolone pigment, Noverperm Carmine HF4C-NVP502, produced by Clariant Japan Co., Ltd.).

(Preparation of Colorant Dispersion Liquid (14))

A colorant dispersion liquid (14) is prepared in the same manner as in the preparation of the colorant dispersion liquid (1) except that the colorant is changed to C.I. Pigment Red 144 (disazo condensation pigment, Chromophthal Red BRN, produced by Ciba Geigy Ltd.).

(Preparation of Colorant Dispersion Liquid (15))

A colorant dispersion liquid (15) is prepared in the same manner as in the preparation of the colorant dispersion liquid (1) except that the colorant is changed to C.I. Pigment Red 254 (diketopyrrolopyrrol pigment, Irgafor Red B-CP, produced by Ciba Geigy Ltd.).

(Preparation of Colorant Dispersion Liquid (16))

A colorant dispersion liquid (16) is prepared in the same manner as in the preparation of the colorant dispersion liquid (1) except that the colorant is changed to C.I. Pigment Blue 15:3 (phthalocyanine pigment, Cyanine Blue 4937, produced by Dainichiseika Color and Chemicals Mfg Co., Ltd.).

(Preparation of Releasing Agent Particle Dispersion Liquid (1))

| | |
|---|---|
| Paraffin wax (HNP-9, produced by Nippon Seiro Co., Ltd.) | 100 parts |
| Anionic surfactant (Lipal 860K, produced by Lion Corp.) | 10 parts |
| Ion exchanged water | 290 parts |

The aforementioned components are mixed and dissolved with each other, and the mixture is dispersed in a homogenizer (Ultra-Turrax, produced by IKA Works, Inc.) and further dispersed with a pressure discharge homogenizer, so as to obtain a releasing agent particle dispersion liquid (1) having releasing agent particles (paraffin wax) having an average particle diameter of 200 nm dispersed therein.

(Preparation of Copper Compound Nitric Acid Aqueous Solution (1))

Concentrated nitric acid (produced by Wako Pure Chemical Industries, Ltd.) is diluted with ion exchanged water to prepare a 1N nitric acid aqueous solution. 0.2 part of copper(I) carbonate (produced by Wako Pure Chemical Industries, Ltd.) is added to 100 parts of the nitric acid aqueous solution (20° C.) to prepare a copper compound nitric acid aqueous solution (1). The copper compound is dissolved in the nitric acid aqueous solution and exhibits pale yellow color.

(Preparation of Copper Compound Nitric Acid Aqueous Solution (2))

A copper compound nitric acid aqueous solution (2) is prepared in the same manner as in the preparation of the copper compound nitric acid aqueous solution (1) except that copper(I) carbonate is changed to copper(II) acetate (produced by Wako Pure Chemical Industries, Ltd.). The copper compound is dissolved in the nitric acid-aqueous solution and exhibits dark green color.

(Preparation of Copper Compound Nitric Acid Aqueous Solution (3))

A copper compound nitric acid aqueous solution (3) is prepared in the same manner as in the preparation of the copper compound nitric acid aqueous solution (1) except that copper(I) carbonate is changed to copper(II) sulfate pentahydrate (produced by Wako Pure Chemical Industries, Ltd.). The copper compound is dissolved in the nitric acid aqueous solution and exhibits blue color.

(Preparation of Ultraviolet Absorbent Dispersion (1))

| | |
|---|---|
| 2,4-Dihydroxybenzophenone | 50 parts |
| 2-Hydroxy-4-n-octyloxybenzophenone | 50 parts |
| Nonionic surfactant (Nonipol 400, produced by Sanyo Chemical Industries, Ltd.) | 100 parts |
| Ion exchanged water | 800 parts |

The aforementioned components are mixed and dissolved with each other, and the mixture is dispersed in a homogenizer (Ultra-Turrax, produced by IKA Works, Inc.) for 30 minutes to obtain an ultraviolet absorbent dispersion liquid (1).

(Production of Yellow Toner (1))

| | |
|---|---|
| Binder resin particle dispersion liquid (1) | 320 parts |
| Colorant dispersion (1) | 80 parts |
| Releasing agent particle dispersion (1) | 96 parts |
| Copper compound nitric acid aqueous solution (1) | 20.2 parts |
| Aluminum sulfate | 1.5 parts |
| Ion exchanged water | 1,270 parts |

The aforementioned components are placed in a round bottom stainless steel flask having a temperature controlling jacket, and dispersed with a homogenizer (Ultra-Turrax T50, produced by IKA Works, Inc.) at 5,000 rpm for 5 minutes, and then the mixture is transferred to a flask and allowed to stand for 20 minutes under stirring with a four-blade puddle at 25° C. Thereafter, the mixture is heated with a mantle heater under stirring at a temperature increasing rate of 1° C. per minute until the temperature of the content reaches 48° C., and maintained at 48° C. for 20 minutes. Subsequently, additional 80 parts of the binder resin particle dispersion liquid (1) is gradually added thereto, and after maintaining at 48° C. for 30 minutes, the pH is adjusted to 6.5 by adding a 1N sodium hydroxide aqueous solution.

The mixture is heated at a temperature increasing rate of 1° C. per minute to 95° C. and maintained for 30 minutes. The pH is adjusted to 4.8 by adding a 0.1N nitric acid aqueous solution, and the mixture is allowed to stand at 95° C. for 2 hours. The pH is then adjusted to 6.5 by adding the 1N sodium hydroxide aqueous solution, and the mixture is allowed to stand at 95° C. for 5 hours. Thereafter, the mixture is cooled at 5° C. per minute to 30° C.

The toner particle dispersion liquid thus completed is filtered, (A) 2,000 parts of ion exchanged water is added to the toner particles thus obtained, (B) the mixture is allowed to stand for 20 minutes, and (C) the toner particles are filtered. The operations from (A) to (C) are repeated in 5 times, and the toner particles on filter paper are placed on a vacuum dryer and dried at 45° C. and 1,000 Pa or less for 10 hours. The pressure is set at 1,000 Pa because water contained in the toner particles freezes at 45° C. in the initial stage of drying, and the water content then sublimes to fluctuate the inner pressure of the dryer upon depressurizing. The pressure is stabilized at 100 Pa upon finishing the drying operation. After making the interior of the dryer at ordinary pressure, the toner particles are taken out to obtain toner mother particles. 0.1 part of a silica external additive (Nippon Aerosil Co., Ltd.) is added to 100 parts of the toner mother particles and mixed in a Henschel mixer at 3,000 rpm for 5 minutes to obtain a yellow toner (1).

The yellow toner (1) thus obtained has D50v of 5.7 μm, GSDp of 1.23, an acid value of 25 mgKOH/g, a glass transition temperature of 53° C., a shape factor SF1 of 132, and $\log_{10}\{[Cu]/[C]\}$ of −4.2.

(Production of Yellow Toner (2))

A yellow toner (2) is prepared in the same manner as in the preparation of the yellow toner (1) except that the colorant dispersion liquid (2) is used instead of the colorant dispersion liquid (1).

The yellow toner (2) thus obtained has D50v of 6.0 μm, GSDp of 1.24, an acid value of 25 mgKOH/g, a glass transition temperature of 53° C., a shape factor SF1 of 133, and $\log_{10}\{[Cu]/[C]\}$ of −4.1.

(Production of Yellow Toner (3))

A yellow toner (3) is prepared in the same manner as in the preparation of the yellow toner (1) except that the colorant dispersion liquid (3) is used instead of the colorant dispersion liquid (1).

The yellow toner (3) thus obtained has D50v of 5.5 μm, GSDp of 1.22, an acid value of 25 mgKOH/g, a glass transition temperature of 53° C., a shape factor SF1 of 130, and $\log_{10}\{[Cu]/[C]\}$ of −4.2.

(Production of Yellow Toner (4))

A yellow toner (4) is prepared in the same manner as in the preparation of the yellow toner (1) except that the colorant dispersion liquid (4) is used instead of the colorant dispersion liquid (1).

The yellow toner (4) thus obtained has D50v of 5.1 μm, GSDp of 1.23, an acid value of 25 mgKOH/g, a glass transition temperature of 53° C., a shape factor SF1 of 131, and $\log_{10}\{[Cu]/[C]\}$ of −4.2.

(Production of Yellow Toner (5))

A yellow toner (5) is prepared in the same manner as in the preparation of the yellow toner (1) except that the colorant dispersion liquid (5) is used instead of the colorant dispersion liquid (1).

The yellow toner (5) thus obtained has D50v of 5.8 μm, GSDp of 1.21, an acid value of 25 mgKOH/g, a glass transition temperature of 53° C., a shape factor SF1 of 132, and $\log_{10}\{[Cu]/[C]\}$ of −4.2.

(Production of Yellow Toner (6))

A yellow toner (6) is prepared in the same manner as in the preparation of the yellow toner (1) except that the colorant dispersion liquid (6) is used instead of the colorant dispersion liquid (1).

The yellow toner (6) thus obtained has D50v of 6.1 μm, GSDp of 1.25, an acid value of 25 mgKOH/g, a glass transition temperature of 53° C., a shape factor SF1 of 135, and $\log_{10}\{[Cu]/[C]\}$ of −4.2.

(Production of Yellow Toner (7))

A yellow toner (7) is prepared in the same manner as in the preparation of the yellow toner (1) except that the colorant dispersion liquid (7) is used instead of the colorant dispersion liquid (1).

The yellow toner (7) thus obtained has D50v of 5.8 μm, GSDp of 1.22, an acid value of 25 mgKOH/g, a glass transition temperature of 53° C., a shape factor SF1 of 128, and $\log_{10}\{[Cu]/[C]\}$ of −4.2.

(Production of Yellow Toner (8))

A yellow toner (8) is prepared in the same manner as in the preparation of the yellow toner (1) except that the colorant dispersion liquid (8) is used instead of the colorant dispersion liquid (1)

The yellow toner (8) thus obtained has D50v of 5.2 μm, GSDp of 1.26, an acid value of 25 mgKOH/g, a glass transition temperature of 53° C., a shape factor SF1 of 132, and $\log_{10}\{[Cu]/[C]\}$ of −4.2.

(Production of Yellow Toner (9))

A yellow toner (9) is prepared in the same manner as in the preparation of the yellow toner (1) except that the amount of the colorant dispersion liquid (1) is changed from 20.2 parts to 80.4 parts.

The yellow toner (9) thus obtained has D50v of 5.3 μm, GSDp of 1.24, an acid value of 25 mgKOH/g, a glass transition temperature of 53° C., a shape factor SF1 of 135, and $\log_{10}\{[Cu]/[C]\}$ of −3.6.

(Production of Yellow Toner (10))

A yellow toner (10) is prepared in the same manner as in the preparation of the yellow toner (1) except that the amount of the colorant dispersion liquid (1) is changed from 20.2 parts to 4.0 parts.

The yellow toner (9) thus obtained has D50v of 5.8 μm, GSDp of 1.26, an acid value of 25 mgKOH/g, a glass transition temperature of 53° C., a shape factor SF1 of 130, and $\log_{10}\{[Cu]/[C]\}$ of −4.9.

(Production of Yellow Toner (11))

A yellow toner (11) is prepared in the same manner as in the preparation of the yellow toner (1) except that the copper compound nitric acid aqueous solution (2) is used instead of the copper compound nitric acid aqueous solution (1).

The yellow toner (11) thus obtained has D50v of 6.2 μm, GSDp of 1.27, an acid value of 25 mgKOH/g, a glass transition temperature of 53° C., a shape factor SF1 of 133, and $\log_{10}\{[Cu]/[C]\}$ of −4.5.

(Production of Yellow Toner (12))

A yellow toner (12) is prepared in the same manner as in the preparation of the yellow toner (1) except that the copper compound nitric acid aqueous solution (3) is used instead of the copper compound nitric acid aqueous solution (1).

The yellow toner (12) thus obtained has D50v of 5.8 μm, GSDp of 1.26, an acid value of 25 mgKOH/g, a glass transition temperature of 53° C., a shape factor SF1 of 135, and $\log_{10}\{[Cu]/[C]\}$ of −4.4.

(Production of Yellow Toner (13))

A yellow toner (13) is prepared in the same manner as in the preparation of the yellow toner (1) except that 0.041 part of copper oxide is added upon aggregation instead of the copper compound nitric acid aqueous solution (1).

The yellow toner (13) thus obtained has D50v of 6.5 μm, GSDp of 1.29, an acid value of 25 mgKOH/g, a glass transition temperature of 53° C., a shape factor SF1 of 138, and $\log_{10}\{[Cu]/[C]\}$ of −4.8, and exhibits relatively dark color in comparison to the yellow toners (1) and (9) to (12) using the same colorant.

(Production of Yellow Toner (14))

101 parts of isophthalic acid, 180 parts of bisphenol A propyleneoxide adduct and 5.4 parts of dibutyltin oxide are placed in a flask, and subjected to a dehydration condensation reaction at a temperature of 230° C. in a nitrogen atmosphere, and the reaction is continued for 16 hours. The resulting polyester resin has an acid value of 42 mgKOH/g and a weight average molecular weight of 4,800.

174 parts of the polyester resin, 16 parts of Pigment Yellow 74 (Seika Fast Yellow 2054, produced by Dainichiseika Color and Chemicals Mfg Co., Ltd.), 10 parts of paraffin wax (HNP-9, produced by Nippon Seiro Co., Ltd.) and 0.016 part of copper(I) carbonate are placed in a Banbury mixer (produced by Kobe Steel, Ltd.) and kneaded under pressure making the interior temperature to 110±5° C. at 80 rpm for 10 minutes. The resulting kneaded product is cooled and then coarsely pulverized with a hammer mill, and the product is finely pulverized to about 6.8 μm with a jet mill. The pulverized product is classified with an elbow jet classifying apparatus (produced by Matsubo Corp.), to which an external additive is added in the same manner as in the production of the yellow toner (1), so as to obtain particles of a yellow toner (14).

The yellow toner (14) thus obtained has D50v of 7.6 μm, GSDp of 1.37, an acid value of 42 mgKOH/g, a glass transition temperature of 63° C., a shape factor SF1 of 155, and $\log_{10}\{[Cu]/[C]\}$ of −4.5.

(Production of Yellow Toner (15))

50 parts of terephthalic acid, 30 parts of dodecenylsuccinic acid, 18 parts of trimellitic anhydride, 85 parts of bisphenol A, 90 parts of bisphenol A propyleneoxide adduct and 5.4 parts of dibutyltin oxide are placed in a flask, and subjected to a dehydration condensation reaction at a temperature of 230° C. in a nitrogen atmosphere, and the reaction is continued for 16 hours. The resulting polyester resin has an acid value of 2 mgKOH/g and a weight average molecular weight of 5,000.

A yellow toner (15) is obtained in the same manner as in the preparation of the yellow toner (14) except that the polyester resin thus obtained is used.

The yellow toner (15) thus obtained has D50v of 8.0 μm, GSDp of 1.38, an acid value of 2 mgKOH/g, a glass transition temperature of 62° C., a shape factor SF1 of 158, and $\log_{10}\{[Cu]/[C]\}$ of −4.7.

(Production of Yellow Toner (16))

32 parts of C.I. Pigment Yellow 74 (Seika Fast Yellow 2054, produced by Dainichiseika Color and Chemicals Mfg Co., Ltd.), 40 parts of paraffin wax (HNP-9, produced by Nippon Seiro Co., Ltd.) and 0.02 part of copper(I) carbonate are added to 28 parts of the polyester resin used for the yellow toner (14), and melted and kneaded in a pressure kneader to obtain a resin mixture.

| | |
|---|---|
| Styrene | 111 parts |
| n-Butyl acrylate | 32 parts |
| 2-Ethylhexyl acrylate | 7 parts |
| tert-Laurylmercaptan | 1.6 parts |
| 2,2'-azobis-2-methylvaleronitrile | 0.7 part |
| (all produced by Wako Pure Chemical Industries, Ltd.) | |
| Resin mixture | 50.0 parts |

The aforementioned components are mixed and melted, and added to an aqueous medium formed by dispersing 10 parts of calcium carbonate in 300 parts of ion exchanged water. The mixture is dispersed with a homogenizer (Ultra-Turrax T50, produced by IKA Works, Inc.), and it is confirmed that oil droplets having an average particle diameter of 8.2 μm are present inside. The dispersed system is heated under a nitrogen stream to 80° C. and allowed to stand for 5 hours to obtain suspension polymerization particles. After cooling, 1N hydrochloric acid (produced by Wako Pure Chemical Industries, Ltd.) is added dropwise thereto to adjust the pH to 2.2, and the dispersion system is allowed to stand for 1 hour.

Thereafter, the pH in the vessel is adjusted to about 7, and the reaction product is filtered and washed 4 times with 500 parts of ion exchanged water. The product is transferred to a vacuum dryer and dried at 45° C. and 1,000 Pa or less for 10 hours. After drying, an external additive is added in the same manner in the yellow toner (1) to obtain a yellow toner (16). The reason why the pressure is 1,000 Pa or less is the same as in the production of the yellow toner (1).

The yellow toner (16) thus obtained has D50v of 8.4 μm, GSDp of 1.32, an acid value of 33 mgKOH/g, a glass transition temperature of 56° C., a shape factor SF1 of 118, and $\log_{10}\{[Cu]/[C]\}$ of −4.5.

(Production of Yellow Toner (17))

A yellow toner (17) is prepared in the same manner as in the preparation of the yellow toner (1) except that the amount of the copper compound nitric acid aqueous solution (1) is changed from 20.2 parts to 160.5 parts, and the amount of ion exchanged water is changed from 1,270 parts to 1,130 parts.

The yellow toner (17) thus obtained has D50v of 5.3 μm, GSDp of 1.23, an acid value of 25 mgKOH/g, a glass transition temperature of 53° C., a shape factor SF1 of 129, and $\log_{10}\{[Cu]/[C]\}$ of −3.3, and exhibits slightly greenish yellow color.

(Production of Yellow Toner (18))

A yellow toner (18) is prepared in the same manner as in the preparation of the yellow toner (1) except that the amount of the copper compound nitric acid aqueous solution (1) is changed from 20.2 parts to 2.0 parts, and the amount of ion exchanged water is changed from 1,270 parts to 1,288 parts.

The yellow toner (18) thus obtained has D50v of 5.7 μm, GSDp of 1.24, an acid value of 25 mgKOH/g, a glass transition temperature of 53° C., a shape factor SF1 of 130, and $\log_{10}\{[Cu]/[C]\}$ of −5.2.

(Production of Yellow Toner (19))

A yellow toner (19) is prepared in the same manner as in the preparation of the yellow toner (1) except that 40 parts of the ultraviolet absorbent dispersion liquid (1) is added, and the amount of ion exchanged water is changed from 1,270 parts to 1,254 parts.

The yellow toner (19) thus obtained has D50v of 5.7 μm, GSDp of 1.24, an acid value of 25 mgKOH/g, a glass transition temperature of 53° C., a shape factor SF1 of 132, and $\log_{10}\{[Cu]/[C]\}$ of −4.1.

(Production of Magenta Toner (1))

A magenta toner (1) is prepared in the same manner as in the preparation of the yellow toner (1) except that the colorant dispersion liquid (9), which is a magenta colorant, is used instead of the colorant dispersion liquid (1).

The magenta toner (1) thus obtained has D50v of 5.5 μm, GSDp of 1.22, an acid value of 25 mgKOH/g, a glass transition temperature of 53° C., a shape factor SF1 of 134, and $\log_{10}\{[Cu]/[C]\}$ of −4.2.

(Production of Magenta Toner (2))

A magenta toner (2) is prepared in the same manner as in the preparation of the magenta toner (1) except that the colorant dispersion liquid (10) is used instead of the colorant dispersion liquid (9).

The magenta toner (2) thus obtained has D50v of 5.5 μm, GSDp of 1.21, an acid value of 25 mgKOH/g, a glass transition temperature of 53° C., a shape factor SF1 of 135, and $\log_{10}\{[Cu]/[C]\}$ of −4.3.

(Production of Magenta Toner (3))

A magenta toner (3) is prepared in the same manner as in the preparation of the magenta toner (1) except that the colorant dispersion liquid (11) is used instead of the colorant dispersion liquid (9).

The magenta toner (3) thus obtained has D50v of 6.4 μm, GSDp of 1.27, an acid value of 25 mgKOH/g, a glass transition temperature of 53° C., a shape factor SF1 of 133, and $\log_{10}\{[Cu]/[C]\}$ of −4.1.

(Production of Magenta Toner (4))

A magenta toner (4) is prepared in the same manner as in the preparation of the magenta toner (1) except that the colorant dispersion liquid (12) is used instead of the colorant dispersion liquid (9).

The magenta toner (4) thus obtained has D50v of 5.6 μm, GSDp of 1.24, an acid value of 25 mgKOH/g, a glass transition temperature of 53° C., a shape factor SF1 of 134, and $\log_{10}\{[Cu]/[C]\}$ of −4.2.

(Production of Magenta Toner (5))

A magenta toner (5) is prepared in the same manner as in the preparation of the magenta toner (1) except that the colorant dispersion liquid (13) is used instead of the colorant dispersion liquid (9).

The magenta toner (5) thus obtained has D50v of 5.1 μm, GSDp of 1.20, an acid value of 25 mgKOH/g, a glass transition temperature of 53° C., a shape factor SF1 of 136, and $\log_{10}\{[Cu]/[C]\}$ of −4.1.

(Production of Magenta Toner (6))

A magenta toner (6) is prepared in the same manner as in the preparation of the magenta toner (1) except that the colorant dispersion liquid (14) is used instead of the colorant dispersion liquid (9).

The magenta toner (6) thus obtained has D50v of 5.1 μm, GSDp of 1.25, an acid value of 25 mgKOH/g, a glass transition temperature of 53° C., a shape factor SF1 of 132, and $\log_{10}\{[Cu]/[C]\}$ of −4.2.

(Production of Magenta Toner (7))

A magenta toner (7) is prepared in the same manner as in the preparation of the magenta toner (1) except that the colorant dispersion liquid (15) is used instead of the colorant dispersion liquid (9).

The magenta toner (7) thus obtained has D50v of 6.1 μm, GSDp of 1.31, an acid value of 25 mgKOH/g, a glass transition temperature of 53° C., a shape factor SF1 of 131, and $\log_{10}\{[Cu]/[C]\}$ of −4.2.

(Production of Magenta Toner (8))

A magenta toner (8) is prepared in the same manner as in the preparation of the magenta toner (1) except that the amount of the copper compound nitric acid aqueous solution (1) is changed from 20.2 parts to 80.4 parts, and the amount of ion exchanged water is changed from 1,270 parts to 1,210 parts.

The magenta toner (8) thus obtained has D50v of 5.6 μl, GSDp of 1.23, an acid value of 25 mgKOH/g, a glass transition temperature of 53° C., a shape factor SF1 of 138, and $\log_{10}\{[Cu]/[C]\}$ of −3.6.

(Production of Magenta Toner (9))

A magenta toner (9) is prepared in the same manner as in the preparation of the magenta toner (1) except that the amount of the copper compound nitric acid aqueous solution (1) is changed from 20.2 parts to 4.0 parts, and the amount of ion exchanged water is changed from 1,270 parts to 1,286 parts.

The magenta toner (9) thus obtained has D50v of 5.8 μm, GSDp of 1.25, an acid value of 25 mgKOH/g, a glass transition temperature of 53° C., a shape factor SF1 of 128, and $\log_{10}\{[Cu]/[C]\}$ of −4.9.

(Production of Magenta Toner (10))

A magenta toner (10) is prepared in the same manner as in the preparation of the magenta toner (1) except that 0.041 part of copper oxide is added upon aggregation instead of the copper compound nitric acid aqueous solution (1).

The magenta toner (10) thus obtained has D50v of 7.8 μm, GSDp of 1.30, an acid value of 25 mgKOH/g, a glass transition temperature of 53° C., a shape factor SF1 of 132, and $\log_{10}\{[Cu]/[C]\}$ of −4.8.

(Production of Magenta Toner (11))

A magenta toner (11) is prepared in the same manner as in the preparation of the yellow toner (14) except that C.I. Pigment Red 122 (anthraquinone pigment, Chromofine Magenta 6887, produced by Dainichiseika Color and Chemicals Mfg Co., Ltd.) is used instead of the colorant used in the production of the yellow toner (14).

The magenta toner (11) thus obtained has D50v of 7.9 μm, GSDp of 1.38, an acid value of 42 mgKOH/g, a glass transition temperature of 63° C., a shape factor SF1 of 158, and $\log_{10}\{[Cu]/[C]\}$ of −4.4.

(Production of Magenta Toner (12))

A magenta toner (12) is prepared in the same manner as in the preparation of the yellow toner (15) except that C.I. Pigment Red 122 (anthraquinone pigment, Chromofine Magenta 6887, produced by Dainichiseika Color and Chemicals Mfg Co., Ltd.) is used instead of the colorant used in the production of the yellow toner (15).

The magenta toner (12) thus obtained has D50v of 8.2 μm, GSDp of 1.37, an acid value of 2 mgKOH/g, a glass transition temperature of 62° C., a shape factor SF1 of 160, and $\log_{10}\{[Cu]/[C]\}$ of −4.5.

(Production of Magenta Toner (13))

A resin mixture is prepared in the same manner as in the preparation of the yellow toner (16) except that C.I. Pigment Red 122 (anthraquinone pigment, Chromofine Magenta 6887, produced by Dainichiseika Color and Chemicals Mfg Co., Ltd.) is used instead of the colorant used in the production of the yellow toner (16).

Suspension polymerization particles are obtained in the same manner as in the production of the yellow toner (16) to obtain a magenta toner (13).

The magenta toner (13) thus obtained has D50v of 8.5 μm, GSDp of 1.35, an acid value of 33 mgKOH/g, a glass transition temperature of 56° C., a shape factor SF1 of 120, and $\log_{10}\{[Cu]/[C]\}$ of −4.4.

(Production of Magenta Toner (14))

A magenta toner (14) is prepared in the same manner as in the preparation of the magenta toner (1) except that the amount of the copper compound nitric acid aqueous solution (1) is changed from 20.2 parts to 160.5 parts, and the amount of ion exchanged water is changed from 1,270 parts to 1,130 parts.

The magenta toner (14) thus obtained has D50v of 5.8 μm, GSDp of 1.24, an acid value of 25 mgKOH/g, a glass transition temperature of 53° C., a shape factor SF1 of 133, and $\log_{10}\{[Cu]/[C]\}$ of −3.3.

The resulting toner exhibits slightly blackish magenta color.

(Production of Magenta Toner (15))

A magenta toner (15) is prepared in the same manner as in the preparation of the magenta toner (1) except that the amount of the copper compound nitric acid aqueous solution (1) is changed from 20.2 parts to 2.0 parts, and the amount of ion exchanged water is changed from 1,270 parts to 1,288 parts.

The magenta toner (15) thus obtained has D50v of 5.8 μm, GSDp of 1.25, an acid value of 25 mgKOH/g, a glass transition temperature of 53° C., a shape factor SF1 of 130, and $\log_{10}\{[Cu]/[C]\}$ of −5.2.

(Production of Magenta Toner (16))

A magenta toner (16) is prepared in the same manner as in the preparation of the magenta toner (1) except that 40 parts of the ultraviolet absorbent dispersion liquid (1) is added, and the amount of ion exchanged water is changed from 1,270 parts to 1,254 parts.

The magenta toner (16) thus obtained has D50v of 5.6 μm, GSDp of 1.24, an acid value of 25 mgKOH/g, a glass transition temperature of 53° C., a shape factor SF1 of 134, and $\log_{10}\{[Cu]/[C]\}$ of −4.1.

(Production of Cyan Toner (1))

A cyan toner (1) is prepared in the same manner as in the preparation of the yellow toner (1) except that the colorant dispersion liquid (16), which is a cyan colorant, is used instead of the colorant dispersion liquid (1).

The cyan toner (1) thus obtained has D50v of 5.8 μm, GSDp of 1.22, an acid value of 25 mgKOH/g, a glass transition temperature of 53° C., a shape factor SF1 of 131, and $\log_{10}\{[Cu]/[C]\}$ of −2.0.

(Production of Cyan Toner (2))

A cyan toner (2) is prepared in the same manner as in the preparation of the yellow toner (14) except that C.I. Pigment Blue 15:3 (phthalocyanine pigment, Cyanine Blue 4937, produced by Dainichiseika Color and Chemicals Mfg Co., Ltd.) is used instead of the colorant used in the production of the yellow toner (14).

The cyan toner (2) thus obtained has D50v of 7.7 μm, GSDp of 1.38, an acid value of 42 mgKOH/g, a glass transition temperature of 63° C., a shape factor SF1 of 159, and $\log_{10}\{[Cu]/[C]\}$ of −2.1.

(Production of Cyan Toner (3))

A cyan toner (3) is prepared in the same manner as in the preparation of the yellow toner (15) except that C.I. Pigment Blue 15:3 (phthalocyanine pigment, Cyanine Blue 4937, produced by Dainichiseika Color and Chemicals Mfg Co., Ltd.) is used instead of the colorant used in the production of the yellow toner (15).

The cyan toner (3) thus obtained has D50v of 8.0 μm, GSDp of 1.40, an acid value of 2 mgKOH/g, a glass transition temperature of 62° C., a shape factor SF1 of 161, and $\log_{10}\{[Cu]/[C]\}$ of −2.1.

(Production of Cyan Toner (4))

A resin mixture is prepared in the same manner as in the preparation of the yellow toner (16) except that C.I. Pigment Blue 15:3 (phthalocyanine pigment, Cyanine Blue 4937, produced by Dainichiseika Color and Chemicals Mfg Co., Ltd.) is used instead of the colorant used in the production of the yellow toner (16).

Suspension polymerization particles are obtained in the same manner as in the production of the yellow toner (16) to obtain a cyan toner (4).

The cyan toner (4) thus obtained has D50v of 8.7 μm, GSDp of 1.33, an acid value of 33 mgKOH/g, a glass transition temperature of 56° C., a shape factor SF1 of 115, and $\log_{10}\{[Cu]/[C]\}$ of −2.1.

(Production of Cyan Toner (5))

A cyan toner (5) is prepared in the same manner as in the preparation of the cyan toner (1) except that 40 parts of the ultraviolet absorbent dispersion liquid (1) is added, and the amount of ion exchanged water is changed from 1,270 parts to 1,254 parts.

The cyan toner (5) thus obtained has D50v of 5.8 μm, GSDp of 1.22, an acid value of 25 mgKOH/g, a glass transition temperature of 53° C., a shape factor SF1 of 133, and $\log_{10}\{[Cu]/[C]\}$ of −2.1.

The characteristic values of the yellow toners (1) to (19), the magenta toners (1) to (16) and the cyan toners (1) to (5) are shown in Table 1 below.

TABLE 1

| Toner | D50v (μm) | GSDp | Acid value (mgKOH/g) | Tg (° C.) | SF1 | log{[Cu]/[C]} |
|---|---|---|---|---|---|---|
| Yellow toner (1) | 5.7 | 1.23 | 25 | 53 | 132 | −4.2 |
| Yellow toner (2) | 6.0 | 1.24 | 25 | 53 | 133 | −4.1 |
| Yellow toner (3) | 5.5 | 1.22 | 25 | 53 | 130 | −4.2 |
| Yellow toner (4) | 5.1 | 1.23 | 25 | 53 | 131 | −4.2 |
| Yellow toner (5) | 5.8 | 1.21 | 25 | 53 | 132 | −4.2 |
| Yellow toner (6) | 6.1 | 1.25 | 25 | 53 | 135 | −4.2 |
| Yellow toner (7) | 5.8 | 1.22 | 25 | 53 | 128 | −4.2 |
| Yellow toner (8) | 5.2 | 1.26 | 25 | 53 | 132 | −4.2 |
| Yellow toner (9) | 5.3 | 1.24 | 25 | 53 | 135 | −3.6 |
| Yellow toner (10) | 5.8 | 1.26 | 25 | 53 | 130 | −4.9 |
| Yellow toner (11) | 6.2 | 1.27 | 25 | 53 | 133 | −4.5 |
| Yellow toner (12) | 5.8 | 1.26 | 25 | 53 | 135 | −4.4 |
| Yellow toner (13) | 6.5 | 1.29 | 25 | 53 | 138 | −4.8 |
| Yellow toner (14) | 7.6 | 1.37 | 42 | 63 | 155 | −4.5 |
| Yellow toner (15) | 8.0 | 1.38 | 2 | 62 | 158 | −4.7 |
| Yellow toner (16) | 8.4 | 1.32 | 33 | 56 | 118 | −4.5 |
| Yellow toner (17) | 5.3 | 1.23 | 25 | 53 | 129 | −3.3 |
| Yellow toner (18) | 5.7 | 1.24 | 25 | 53 | 130 | −5.2 |
| Yellow toner (19) | 5.7 | 1.24 | 25 | 53 | 132 | −4.1 |
| Magenta toner (1) | 5.5 | 1.22 | 25 | 53 | 134 | −4.2 |
| Magenta toner (2) | 5.5 | 1.21 | 25 | 53 | 135 | −4.3 |
| Magenta toner (3) | 6.4 | 1.27 | 25 | 53 | 133 | −4.1 |
| Magenta toner (4) | 5.6 | 1.24 | 25 | 53 | 134 | −4.2 |
| Magenta toner (5) | 5.1 | 1.20 | 25 | 53 | 136 | −4.1 |
| Magenta toner (6) | 5.1 | 1.25 | 25 | 53 | 132 | −4.2 |
| Magenta toner (7) | 6.1 | 1.31 | 25 | 53 | 131 | −4.2 |
| Magenta toner (8) | 5.6 | 1.23 | 25 | 53 | 138 | −3.6 |
| Magenta toner (9) | 5.8 | 1.25 | 25 | 53 | 128 | −4.9 |
| Magenta toner (10) | 7.8 | 1.38 | 42 | 61 | 132 | −4.8 |
| Magenta toner (11) | 7.9 | 1.38 | 42 | 63 | 158 | −4.4 |
| Magenta toner (12) | 8.2 | 1.37 | 2 | 62 | 160 | −4.5 |
| Magenta toner (13) | 8.5 | 1.35 | 33 | 56 | 120 | −4.4 |
| Magenta toner (14) | 5.8 | 1.24 | 25 | 53 | 133 | −3.3 |
| Magenta toner (15) | 5.8 | 1.25 | 25 | 53 | 130 | −5.2 |
| Magenta toner (16) | 5.6 | 1.24 | 25 | 53 | 134 | −4.1 |
| Cyan toner (1) | 5.8 | 1.22 | 25 | 53 | 131 | −2.0 |
| Cyan toner (2) | 7.7 | 1.38 | 42 | 63 | 159 | −2.1 |
| Cyan toner (3) | 8.0 | 1.40 | 2 | 62 | 161 | −2.1 |
| Cyan toner (4) | 8.7 | 1.33 | 33 | 56 | 115 | −2.1 |
| Cyan toner (5) | 5.8 | 1.22 | 25 | 53 | 133 | −2.1 |

(Production of Carrier)

1,000 parts of Mn−Mg ferrite (average particle diameter: 50 μm, produced by Powdertech Co., Ltd.) is placed in a kneader, to which a solution obtained by dissolving 150 parts of a styrene-methyl methacrylate copolymer (polymerization ratio: 40/60, Tg: 90° C., weight average molecular weight: 72,000, produced by Soken Chemical Co., Ltd.) in 700 parts of toluene is added, and mixed at ordinary temperature for 20 minutes. The mixture is overheated to 70° C. and dried under reduced pressure, and thus a coated carrier is taken out. The coated carrier thus obtained is sieved with a mesh of 75 μm to remove coarse particles to obtain a carrier (1)

(Production of Developer)

The carrier (1) is mixed with the yellow toners (1) to (19), the magenta toners (1) to (16) and the cyan toners (1) to (5), respectively, at a weight ratio of 95/5 in a V-blender for 20 minutes to obtain electrophotographic developers.

(Formation of Fixed Images) The electrophotographic developers using the yellow toners (1) to (19), the magenta toners (1) to (16) and the cyan toners (1) to (5) are installed in a developer of a modified machine of DocuCentre Color 320CP (produced by Fuji Xerox Co., Ltd.) in the combinations shown in Table 2 below, and images of the test chart No. 5-1 by the Imaging Society of Japan are output on J Paper (produced by Fuji Xerox Co., Ltd.). As a black developer for forming the images, the toner for DocuCentre Color 320CP is used as it is because a black developer is generally difficult to suffer discoloration or decoloration in comparison to yellow, magenta and cyan developers.

Examples 1 to 26 and Comparative Examples 1 to 4

The combinations of yellow, magenta and cyan toners used in Examples 1 to 26 and Comparative Examples 1 to 4 are shown in Table 2 below. While the developers are used for development, the toners that are actually used are shown in Table 2. The black toner used is the toner for DocuCentre Color 320CP and is not shown in Table 2.

TABLE 2

| | Yellow | Magenta | Cyan |
|---|---|---|---|
| Example 1 | yellow toner (1) | magenta toner (1) | cyan toner (1) |
| Example 2 | yellow toner (2) | magenta toner (1) | cyan toner (1) |
| Example 3 | yellow toner (3) | magenta toner (1) | cyan toner (1) |
| Example 4 | yellow toner (4) | magenta toner (1) | cyan toner (1) |
| Example 5 | yellow toner (5) | magenta toner (1) | cyan toner (1) |
| Example 6 | yellow toner (6) | magenta toner (1) | cyan toner (1) |
| Example 7 | yellow toner (7) | magenta toner (1) | cyan toner (1) |
| Example 8 | yellow toner (8) | magenta toner (1) | cyan toner (1) |
| Example 9 | yellow toner (1) | magenta toner (2) | cyan toner (1) |
| Example 10 | yellow toner (1) | magenta toner (3) | cyan toner (1) |
| Example 11 | yellow toner (1) | magenta toner (4) | cyan toner (1) |
| Example 12 | yellow toner (1) | magenta toner (5) | cyan toner (1) |
| Example 13 | yellow toner (1) | magenta toner (6) | cyan toner (1) |
| Example 14 | yellow toner (1) | magenta toner (7) | cyan toner (1) |
| Example 15 | yellow toner (1) | magenta toner (8) | cyan toner (1) |
| Example 16 | yellow toner (1) | magenta toner (9) | cyan toner (1) |
| Example 17 | yellow toner (9) | magenta toner (1) | cyan toner (1) |
| Example 18 | yellow toner (10) | magenta toner (1) | cyan toner (1) |
| Example 19 | yellow toner (11) | magenta toner (1) | cyan toner (1) |
| Example 20 | yellow toner (12) | magenta toner (1) | cyan toner (1) |
| Example 21 | yellow toner (13) | magenta toner (1) | cyan toner (1) |
| Example 22 | yellow toner (1) | magenta toner (10) | cyan toner (1) |
| Example 23 | yellow toner (14) | magenta toner (11) | cyan toner (2) |
| Example 24 | yellow toner (15) | magenta toner (12) | cyan toner (3) |
| Example 25 | yellow toner (16) | magenta toner (13) | cyan toner (4) |
| Example 26 | yellow toner (19) | magenta toner (16) | cyan toner (5) |
| Comparative Example 1 | yellow toner (1) | magenta toner (14) | cyan toner (1) |
| Comparative Example 2 | yellow toner (1) | magenta toner (15) | cyan toner (1) |
| Comparative Example 3 | yellow toner (17) | magenta toner (1) | cyan toner (1) |
| Comparative Example 4 | yellow toner (18) | magenta toner (1) | cyan toner (1) |

(Evaluation of Discoloration and Decoloration)

The fixed images of Examples 1 to 26 and Comparative Examples 1 to 4 are tested for discoloration and decoloration by using a desktop exposure tester (Suntest CPS+, produced by Toyo Seiki Seisaku-sho, Ltd.). A xenon arc lamp (1,500 W) is used as a light source, and the fixed image is disposed at a position with a distance of about 20 cm from the light source. The irradiation test is carried out at a humidity of 50% and a surface temperature of the standard blackbody of 40° C. Since the humidity and the surface temperature of the standard blackbody are fluctuated depending on the environments of the tester, the humidity is 50±5%, and the surface temperature of the standard blackbody is 40±5° C. The irradiation time is 120 hours, 240 hours or 360 hours, and discoloration and decoloration of the part of flesh color in the test chart No. 5-1 by the Imaging Society of Japan are visually evaluated by comparing the original test chart No. 5-1 by the Imaging Society of Japan. The results obtained are shown in Table 3 below.

lowered, but it is such a level that causes no practical problem, and thus the discoloration and decoloration test is continued.

The results shown in Table 3 reveal the following. The toner of the invention is excellent in reproducibility of flesh color and also excellent in resistance to discoloration and decoloration by an ultraviolet ray. The toner having a value $\log_{10}\{[Cu]/[C]\}$ exceeding −3.5, which is the upper limit of the invention, colors a flesh color part brown due to the color inherent to the copper compound, and the toner having a value $\log_{10}\{[Cu]/[C]\}$ of less than −5.0, which is the lower limit of the invention, is inferior in balance of flesh color due to discoloration and decoloration of the toner.

In the case where a divalent copper compound or an organic copper compound, which has dark color, is used as the copper compound, a slight problem occurs in reproducibility of flesh color.

In the case where a water insoluble copper compound is used, the case where a copolymer obtained by the suspension polymerization method is used, and the case where a

TABLE 3

| | Discoloration and decoloration of flesh color after 120 hr irradiation | Discoloration and decoloration of flesh color after 240 hr irradiation | Discoloration and decoloration of flesh color after 360 hr irradiation |
|---|---|---|---|
| Example 1 | no problem | no problem | no problem |
| Example 2 | no problem | no problem | no problem |
| Example 3 | no problem | no problem | no problem |
| Example 4 | no problem | no problem | no problem |
| Example 5 | no problem | no problem | no problem |
| Example 6 | no problem | no problem | no problem |
| Example 7 | no problem | no problem | no problem |
| Example 8 | no problem | no problem | no problem |
| Example 9 | no problem | no problem | no problem |
| Example 10 | no problem | no problem | no problem |
| Example 11 | no problem | no problem | no problem |
| Example 12 | no problem | no problem | no problem |
| Example 13 | no problem | no problem | no problem |
| Example 14 | no problem | no problem | no problem |
| Example 15 | no problem | no problem | no problem |
| Example 16 | no problem | slightly discolored yellow | slightly discolored yellow |
| Example 17 | no problem | no problem | no problem |
| Example 18 | no problem | slightly discolored red | slightly discolored yellow |
| Example 19 | no problem | no problem | no problem |
| Example 20 | no problem | no problem | no problem |
| Example 21 | no problem | slightly discolored red | somewhat discolored red |
| Example 22 | no problem | slightly discolored yellow | somewhat discolored yellow |
| Example 23 | no problem | slightly discolored blue | somewhat discolored blue |
| Example 24 | no problem | somewhat discolored blue | somewhat discolored blue |
| Example 25 | no problem | slightly discolored blue | somewhat discolored blue |
| Example 26 | no problem | no problem | no problem |
| Comparative Example 1 | The test is not conducted because the flesh color part is colored brown in the initial stage. | | |
| Comparative Example 2 | no Problem | somewhat discolored yellow | discolored to yellow |
| Comparative Example 3 | The test is not conducted because the flesh color part is colored brown in the initial stage. | | |
| Comparative Example 4 | no problem | somewhat discolored to red | discolored to red |

In the reproducibility of flesh color in Examples 15, 17 and 19 shown in Table 3, the chroma saturation is slightly toner obtained by the kneading and pulverizing method is used, the effect of the invention is not outstanding in comparison to the case where a water soluble copper compound is used in combination with a toner obtained by the emulsion polymerization aggregation method.

The fixed images of Example 26 and Example 1 are subjected to the aforementioned discoloration and decoloration test for 480 hours. The image of Example 1 is slightly discolored after lapsing 480 hours, but no discoloration occurs in the image of Example 26. Thus, an outstanding effect is obtained in resistance to discoloration and decoloration by adding an ultraviolet absorbent to the toner of the invention.

What is claimed is:

1. An electrophotographic toner comprising:

a binder resin; and a colorant, wherein:

$\log_{10}\{[Cu]/[C]\}$ is satisfactory witgh the following equation (1):

$$-5.0 \leq \log_{10}\{[Cu]/[C]\} - 3.5 \quad (1)$$

wherein

[C] represents a carbon content (%) measured with fluorescent X-ray, and [Cu] represents a copper content (%) measured with fluorescent X-ray.

2. The electrophotographic toner according to claim 1, wherein the colorant contains at least one of a pigment of a yellow colorant, a pigment of a magenta colorant, a dye of a yellow colorant, and a dye of a magenta colorant.

3. The electrophoto graphic toner according to claim 1, wherein the colorant is an organic colorant having a chromophoric group selected from the group consisting of an anisidino group, an anisoyl group, an anilino group, an isoquinolyl group, an isonicotinoyl group, an isophthaloyl group, an indolyl group, a quinolidino group, a xanthenyl group, a xylyl group, a quinolyl group, a salicylidene group, a salicyl group, a salicyloyl group, a diphenylamino group, a diphenylmethylene group, a cinnamyl group, a cinnamoyl group, a styryl group, a sulfanylyl group, a sulfanylamide group, a toluidino group, a toluoyl group, a naphthylazo group, a naphthyloxy group, a naphthoyl group, a naphthoyloxy group, a nicotinoyl group, a piperidino group, a piperidyl group, a piperonyl group, a pimeloyl group, a pyrazinyl group, a pyrazonyl group, a pyrazolyl group, a pyranyl group, a pyridinio group, a pyridyl group, a pyridyloxy group, a 2-pyridinecarbonyl group, a pyrimidinyl group, a pyrrolidinyl group, a pyrrolinyl group, a pyrrolyl group, a phenylazo group, a phenylimino group, a phenylcarbamoyl group, a phenylsulfamoyl group, a phenylsulfinyl group, a phenylsulfonylamino group, a phenylthio group, a phenylacetyl group, a phenacylidene group, a phenacyl group, a phthalidylidene group, a phthalidyl group, a phthalimide group, a phthaloyl group, a furyl group, a fluorenyl group, a fluorenylidene group, a benzilidene group, a benzyloxy group, a benzyloxycarbonyl group, a benzylthio group, a benzamide group, a benzimidoyl group, a benzhydrilidene group, a benzoylimino group, a benzoyloxy group, a benzoquinonyl group and a benzofuranyl group.

4. The electrophotographic toner according to claim 1, wherein the colorant contains at least one of a monoazo pigment, a benzimidazolone pigment, a disazo condensation pigment, an isoindolinone pigment, an anthraquinone pigment, a disazo pigment, an azolake pigment and an quinophthalone pigment.

5. The electrophotographic toner according to claim 1, wherein a compound exhibiting a copper strength is an inorganic copper compound.

6. The electrophotographic toner according to claim 1, wherein a compound exhibiting a copper strength is an inorganic copper compound, and the inorganic copper compound is water soluble.

7. The electrophotographic toner according to claim 1, wherein a compound exhibiting a copper strength is an inorganic copper compound, and a copper atom of the inorganic copper compound is monovalent.

8. The electrophotographic toner according to claim 1, wherein GSDp is of 1.23 or less, where GSDp represents a particle size distribution of the electrophotographic toner.

9. The electrophotographic toner according to claim 1, wherein a shape factor SF1 of the electrophotographic toner is from 110 to 140.

10. The electrophoto graphic toner according to claim 1, further comprising a releasing agent.

11. The electrophotographic toner according to claim 1, further comprising an ultraviolet absorbent.

12. The electrophotographic toner according to claim 1, further containing water in an amount of from 0.3 to 3.0% based on the total weight of the electrophotographic toner.

13. A method for producing for producing an electrophotographic toner comprising:

aggregating binder resin particles having a particle diameter of 1 μm or less and a colorant to form aggregated particles having a diameter of a toner particle diameter by mixing a binder resin particle dispersion liquid having the binder resin particles dispersed therein and a colorant dispersion liquid having the colorant dispersed therein; and fusing the aggregated particles to form toner particles by heating to a temperature equal to or higher than a glass transition temperature of the binder resin particles, wherein a copper compound is made present in at least one of the aggregating and the fusing for controlling a carbon content [C] (%) and a copper content [Cu] (%) measured with fluorescent X-ray to satisfy the following equation (1):

$$-5.0 \leq \log_{10}\{[Cu]/[C]\} \leq -3.5 \quad (1).$$

14. The method according to claim 13, further comprising aggregating the binder resin particle dispersion liquid and the colorant dispersion liquid along with a copper compound.

15. The method according to claim 13, further comprising aggregating the binder resin particle dispersion liquid and the colorant dispersion liquid along with a copper compound and an ultraviolet absorbent.

16. The method according to claim 13, wherein the toner is controlled to contain water in an amount of from 0.3 to 3.0% based on the total weight of the toner.

17. An electrophotographic developer comprising:

an electrophotographic toner; and a carrier, wherein the electrophotographic toner includes:

a binder resin; and a colorant, wherein $\log_{10}\{[Cu]/[C]\}$ is satisfactory with the following equation (1):

$$-5.0 \leq \log_{10}\{[Cu]/[C]\} \leq -3.5 \quad (1)$$

wherein

[C] represents a carbon content (%) measured with fluorescent X-ray, and [Cu] represents a copper content (%) measured with fluorescent X-ray.

18. The electrophotographic developer according to claim 17, wherein the colorant contains at least one of a monoazo pigment, a benzimidazolone pigment, a disazo condensation pigment, an isoindolinone pigment, an anthraquinone pigment, a disazo pigment, an azolake pigment and an quinophthalone pigment.

19. The electrophotographic developer according to claim 18, wherein a compound exhibiting a copper strength is an inorganic copper compound.

* * * * *